US006029041A

United States Patent [19]

Takano et al.

[11] Patent Number: 6,029,041

[45] Date of Patent: Feb. 22, 2000

[54] IMAGE FORMING APPARATUS

[75] Inventors: Yoshiaki Takano, Toyohashi; Kazuo Okunishi, Okazaki; Hideki Hino, Toyokawa; Kentaro Nagatani, Toyohashi, all of Japan

[73] Assignee: Minolta Co., Ltd., Osaka, Japan

[21] Appl. No.: 09/196,237

[22] Filed: Nov. 20, 1998

[30] Foreign Application Priority Data

| | | | |
|---|---|---|---|
| Nov. 21, 1997 | [JP] | Japan | 9-321788 |
| Nov. 21, 1997 | [JP] | Japan | 9-321789 |
| Aug. 7, 1998 | [JP] | Japan | 10-224610 |

[51] Int. Cl.[7] ..... G03G 15/00; G03G 15/01

[52] U.S. Cl. ..... 399/388; 399/303; 399/394

[58] Field of Search ..... 399/388, 389, 399/391, 394, 401, 303, 306, 316

[56] References Cited

U.S. PATENT DOCUMENTS

| | | | |
|---|---|---|---|
| 4,853,740 | 8/1989 | Ushio et al. | 399/402 |
| 4,928,128 | 5/1990 | Stemmle | 399/364 |
| 5,159,395 | 10/1992 | Farrell et al. . | |
| 5,629,760 | 5/1997 | Hayashi et al. | 399/394 X |
| 5,678,138 | 10/1997 | Kobayashi et al. | 399/388 X |
| 5,724,633 | 3/1998 | Amemiya | 399/303 X |
| 5,784,676 | 7/1998 | Iseki et al. | 399/301 |
| 5,819,140 | 10/1998 | Iseki et al. | 399/303 X |
| 5,839,045 | 11/1998 | Wierszewski | 399/382 |

FOREIGN PATENT DOCUMENTS

| | | |
|---|---|---|
| 63-106247 | 5/1988 | Japan . |
| 4-149564 | 5/1992 | Japan . |
| 05002347 | 8/1993 | Japan . |
| 06035261 | 10/1994 | Japan . |
| 6-35262 | 10/1994 | Japan . |
| 8-194393 | 7/1996 | Japan . |

*Primary Examiner*—Matthew S. Smith
*Attorney, Agent, or Firm*—McDermott, Will & Emery

[57] ABSTRACT

An image forming apparatus includes a recording sheet feeding member which feeds a recording sheet on a feed tray to a transporting path, an endless recording sheet transporting member having an inappropriate portion which is not suitable for use in forming an image, a transporting member which transports the recording sheet fed from the recording sheet feeding member to the recording sheet transporting member, and an inappropriate portion detector which detects an inappropriate portion on the recording sheet transporting member. A controller controls the transporting member such that the recording sheet is fed so as to avoid the inappropriate portion based on a result detected by the inappropriate portion detector.

21 Claims, 35 Drawing Sheets

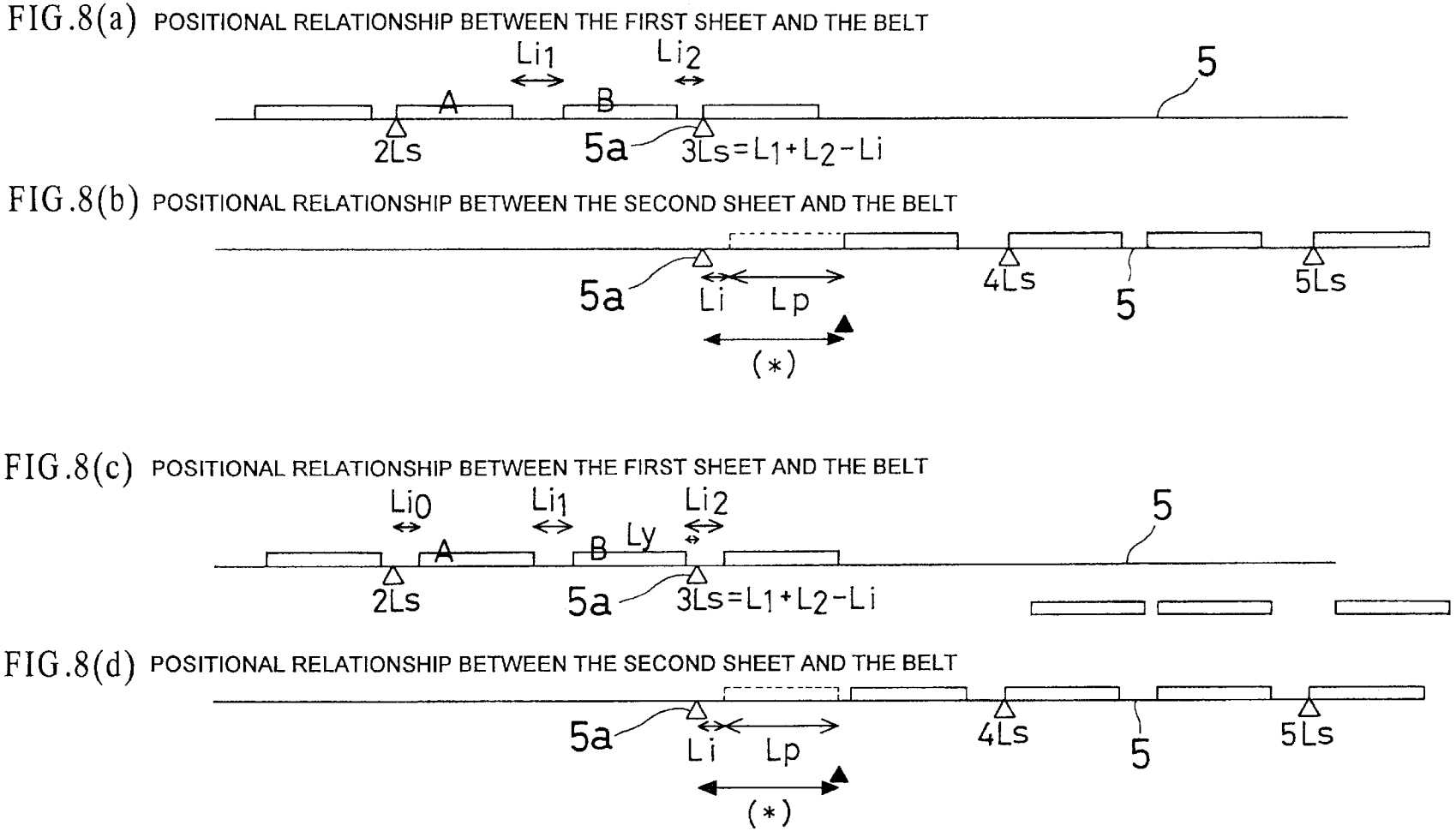
FIG.8(a) POSITIONAL RELATIONSHIP BETWEEN THE FIRST SHEET AND THE BELT
FIG.8(b) POSITIONAL RELATIONSHIP BETWEEN THE SECOND SHEET AND THE BELT
FIG.8(c) POSITIONAL RELATIONSHIP BETWEEN THE FIRST SHEET AND THE BELT
FIG.8(d) POSITIONAL RELATIONSHIP BETWEEN THE SECOND SHEET AND THE BELT

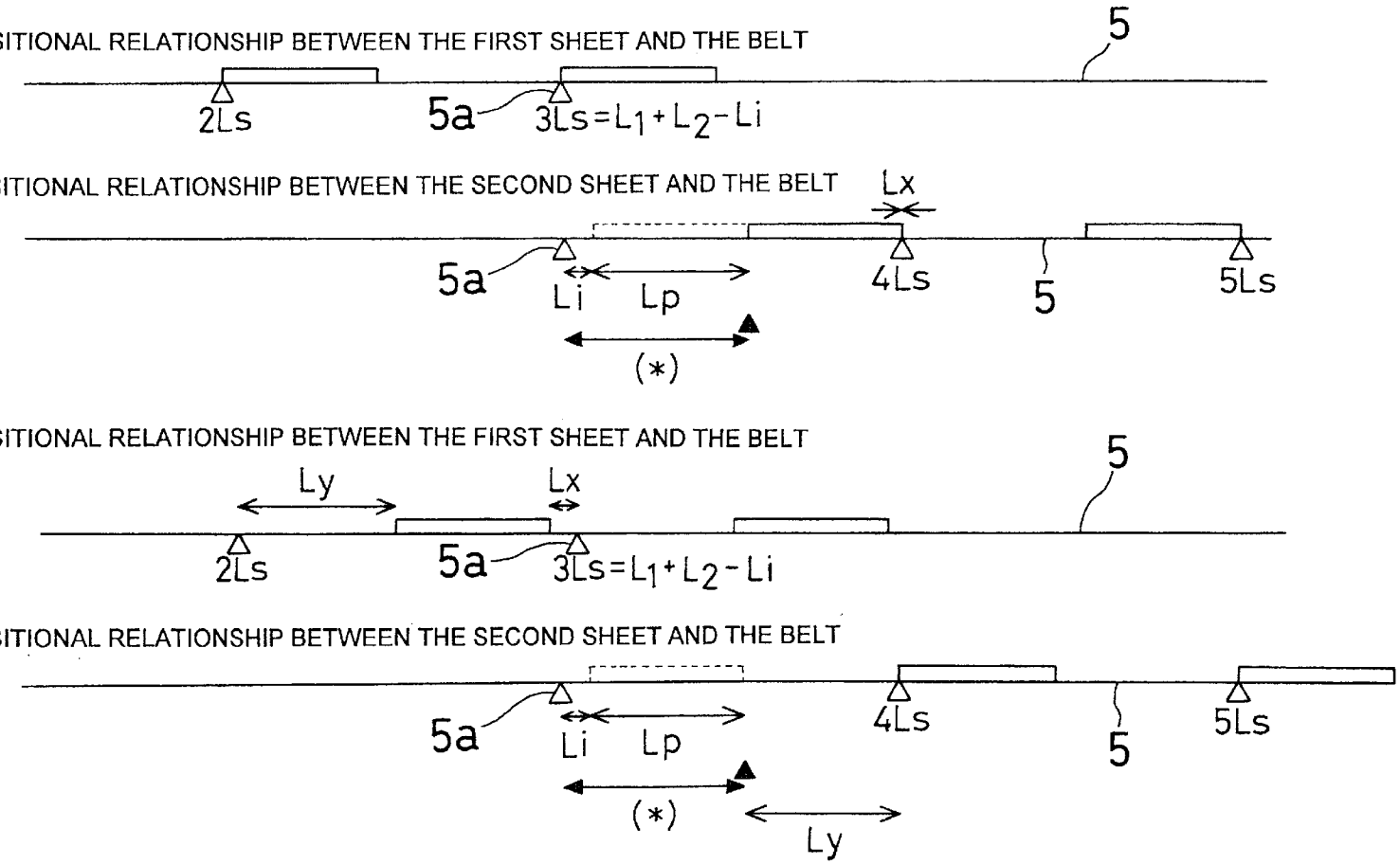
FIG.9(a) POSITIONAL RELATIONSHIP BETWEEN THE FIRST SHEET AND THE BELT
FIG.9(b) POSITIONAL RELATIONSHIP BETWEEN THE SECOND SHEET AND THE BELT
FIG.9(c) POSITIONAL RELATIONSHIP BETWEEN THE FIRST SHEET AND THE BELT
FIG.9(d) POSITIONAL RELATIONSHIP BETWEEN THE SECOND SHEET AND THE BELT

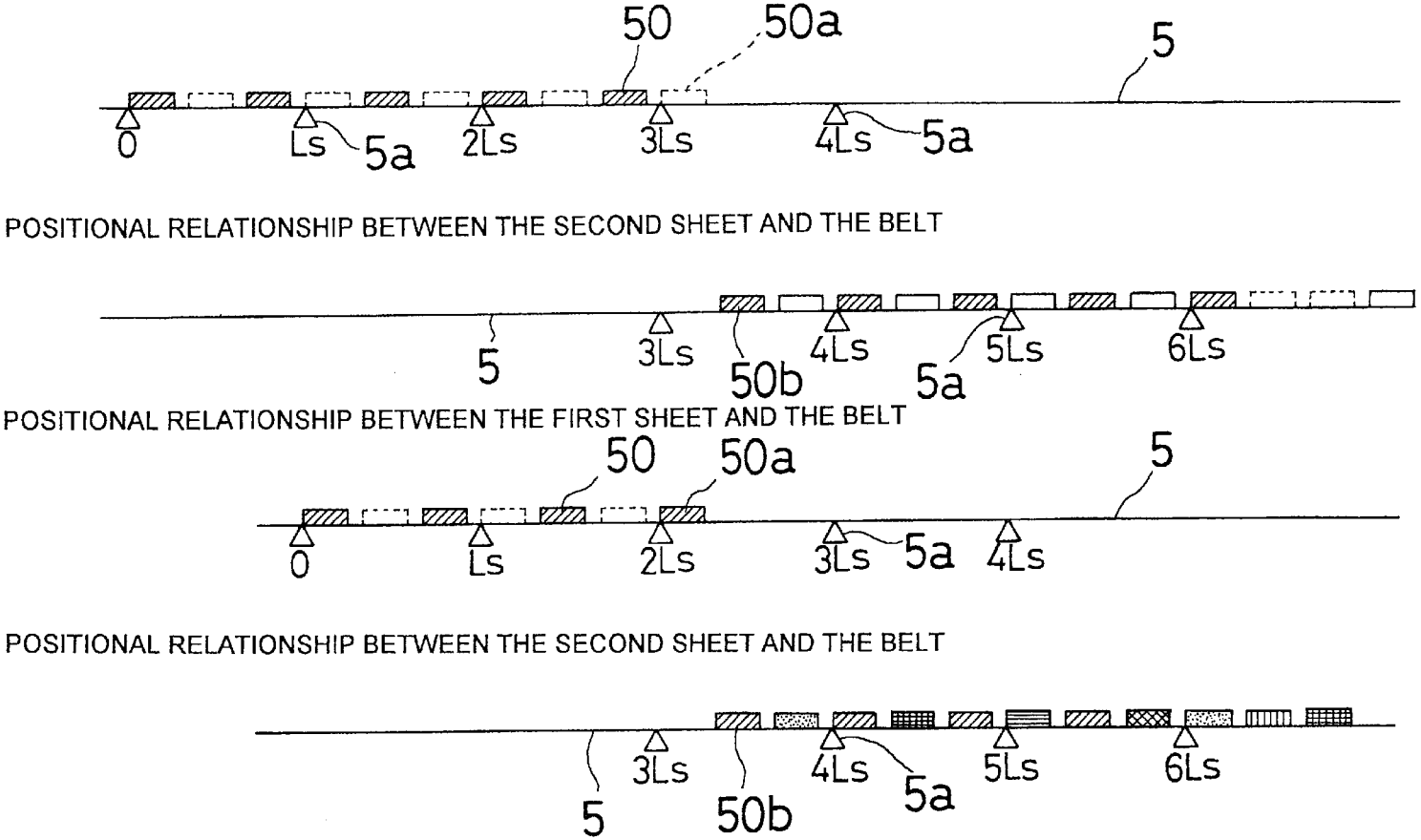
FIG.10(a) POSITIONAL RELATIONSHIP BETWEEN THE FIRST SHEET AND THE BELT
FIG.10(b) POSITIONAL RELATIONSHIP BETWEEN THE SECOND SHEET AND THE BELT
FIG.10(c) POSITIONAL RELATIONSHIP BETWEEN THE FIRST SHEET AND THE BELT
FIG.10(d) POSITIONAL RELATIONSHIP BETWEEN THE SECOND SHEET AND THE BELT

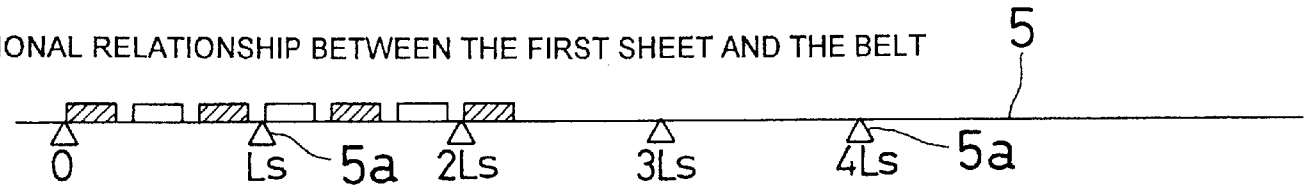
FIG.11(a) POSITIONAL RELATIONSHIP BETWEEN THE FIRST SHEET AND THE BELT
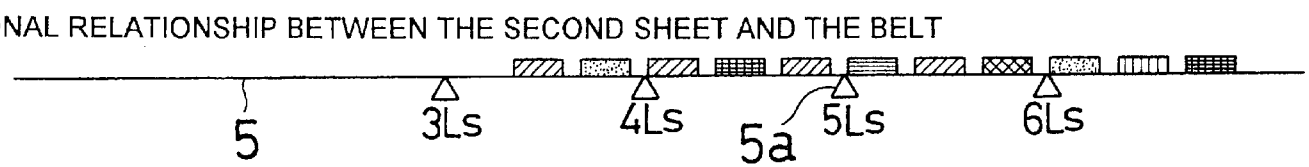
FIG.11(b) POSITIONAL RELATIONSHIP BETWEEN THE SECOND SHEET AND THE BELT
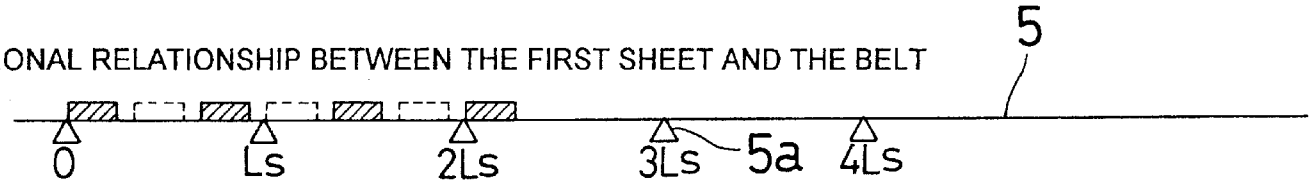
FIG.11(c) POSITIONAL RELATIONSHIP BETWEEN THE FIRST SHEET AND THE BELT
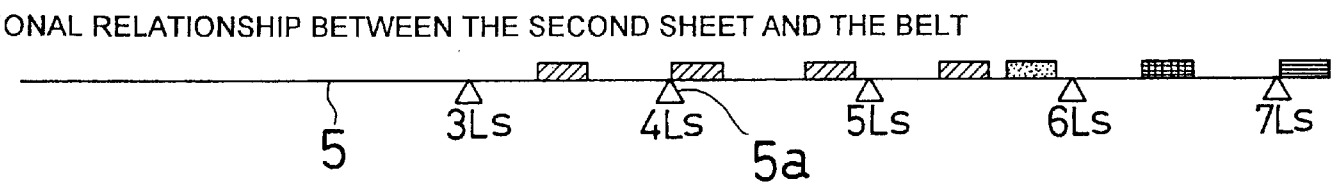
FIG.11(d) POSITIONAL RELATIONSHIP BETWEEN THE SECOND SHEET AND THE BELT

| | | |
|---|---|---|
| VALID / INVALID | X1 | W1 |
| VALID / INVALID | X2 | W2 |
| VALID / INVALID | X3 | W3 |
| | . . . | |
| VALID / INVALID | Xi | Wi |

IMAGE FORMING APPARATUS

BACKGROUND OF THE INVENTION

1. Field of the Invention

The present invention relates to an image forming apparatus, for example, an electrophotography type, an electrostatic recording type image forming apparatus, or the like, and more particularly, to a Tandem type color image forming apparatus such as a color copying machine, a color printer, or a similar apparatus, wherein a plurality of image forming units are provided to form a plurality of images, each different in color, on respective image storing members, and then these images are transferred, one on another, in turn, on the same recording sheet, held and transported by a recording sheet transporting member.

2. Description of the Related Art

For example, in a Tandem type image forming apparatus, a recording sheet is fed to an image-transfer belt (as an example of a recording sheet transporting member) and then an image is transferred to the recording sheet from a photosensitive drum. The image-transfer belt is generally made by adhering opposite ends of a belt having a uniform thickness to form an endless belt in order to prevent a shear in color printing. However, a uniform thickness cannot be obtained at the seam of the endless belt thereby causing a shear in color printing. To avoid the shear in color printing, it is required to control the feeding of the recording sheet to the image-transfer belt such that the recording sheet is not located on the seam.

An image forming apparatus which meets the above demands has been described in Japanese Unexamined Laid-open Patent Publication No. H5(1993)-2347. In the apparatus, a paper-feed control is performed based on the size of the recording sheet and the detected location of the seam in order to feed recording sheets to an image-transfer belt so that they are not located on the seam.

However, in the image forming apparatus according to the Japanese Unexamined Laid-open Patent Publication No. H5-2347, only the timing at which a paper-supply rollers, which supplies a sheet of paper from a paper-supply tray into a transport path, is controlled. Thus, if slipping occurs between the paper-supply rollers and the recording sheet, compensation of the slipping cannot be made.

Recently, there is a tendency to increase the types of recording sheets which be may recorded on by the image forming apparatus, to allow a diversification of thickness, materials, etc., of the recording sheet. This increases the chance for and amount of slipping of the recording sheet when the recording sheet is supplied. Accordingly, it is difficult to satisfy demands of a recent image forming apparatuses only by the above-mentioned paper-supply control based on the size of the recording sheet and the detected seam location.

Recently, a demand has been growing for an image forming apparatus which can form images on both sides of a recording sheet. Such an image forming apparatus is proposed by Japanese Examined Laid-open Patent Publication No. H1(1989)-29111.

This Japanese Examined Laid-open Patent Publication discloses a technique concerning image forming on both sides of the recording sheet by circulating the recording sheet, but fails to disclose a technique concerning a countermeasure against slipping of the recording sheet caused when the recording sheet is fed and/or a technique concerning a paper-feed control for preventing the recording sheet from being located on the seam.

In order to efficiently feed recording sheets while preventing the sheet from being located on the seam, Japanese Unexamined Laid-open Patent Publication H6(1994)-35621 has proposed an image forming apparatus in which the relationship of a length of a recording sheet, an interval between recording sheets and a circumferential length, i.e., a total length, of an image-transfer belt is defined. However, in this image forming apparatus, a two-sided image forming is not considered at all. Therefore, by merely defining the above mentioned relationship, it is hard to expect an improved paper feeding efficiency in two-sided image forming and an improved productivity.

On the other hand, another image forming apparatus by which an image forming is performed on both sides of the recording sheet has been proposed by, for example, U.S. Pat. No. 5,159,395. These proposals attempt to increase the productivity of image forming by arranging papers on which images are formed in a certain order.

However, in this image forming apparatus, the recording sheet, which is inverted and transported from an inverting circulation path after an image is formed on one side (front surface) of the recording sheet, is fed to the image-transfer belt to form an image on the other side (back surface) of the recording sheet again. At the time, if it is required to prevent the recording sheet from being located on a seam of the belt, the transportation of the recording sheet may sometimes be required to stop, thereby resulting in a poor productivity.

SUMMARY OF THE INVENTION

It is an object of the present invention to provide an image forming apparatus in which a recording sheet can be transported to a recording sheet transporting member so as to prevent from being located on an inappropriate area of the transporting member such as a seam in forming an image not only on one side of the recording sheet but also on both sides thereof.

It is another object of the present invention to provide an image forming apparatus which can cope with slipping of the recording sheet caused when the recording sheet is fed.

It is still another object of the present invention to provide an image forming apparatus which can control feeding a recording sheet so as to effectively prevent the recording sheet from being located on an inappropriate portion of a transporting member in forming an image not only on one side (front surface) of the recording sheet but also on the other side (back surface) thereof.

According to one aspect of the present invention, an image forming apparatus includes a recording sheet supplying member which supplies a recording sheet placed on a recording sheet supply tray to a transporting path, a recording sheet transporting member which has an inappropriate portion not suitable for use in forming an image and transports a recording sheet while holding the recording sheet thereon, the recording sheet transporting member being endless, a recording sheet feeding member which feeds the recording sheet transferred from the recording sheet supplying member to the recording sheet transporting member, an inappropriate portion detector which detects the inappropriate portion, and a controller which drives the recording sheet supplying member by sending a request for supplying the recording sheets and controls the recording sheet feeding member so that the recording sheet is not located on the inappropriate portion based on a detected result of the inappropriate portion detector.

In the image forming apparatus, since the recording sheet supplying member, which supplies the recording sheet on the recording sheet transporting member, is driven based on a detected result of the inappropriate portion detector, the recording sheet is fed to the recording sheet transporting member so that the recording sheet is not located on the inappropriate portion such as a seam. Further, since the control to avoid the inappropriate portion is made to the recording sheet supplying member, a time period for supplying the recording sheets by the recording sheet supplying member can be set to be shorter than that for feeding the recording sheets to the recording sheet transporting member by the recording sheet feeding member. As a result, even if slipping of the recording sheet occurs when the recording sheet is fed, such slipping can be compensated for so as not to affect the feeding of the recording sheet to the recording sheet transporting member.

According to another aspect of the present invention, an image forming apparatus includes a recording sheet supplying member which supplies a recording sheet placed on a recording sheet supply tray to a transporting path, a recording sheet transporting member which has an inappropriate portion not suitable for forming an image and transports a recording sheet while holding the recording sheet thereon, the recording sheet transporting member being endless, a recording sheet feeding member which feeds the recording sheet transferred from the recording sheet supplying member to the recording sheet transporting member, an inappropriate portion detector which detects the inappropriate portion, a circular re-feeding member which re-feeds the recording sheet on the recording sheet transporting member to the recording sheet feeding member, a recording sheet detector which detects a position of the recording sheet re-fed by the circular re-feeding member, and a controller which controls the recording sheet supplying member so that the recording sheet is supplied to the transporting path so as to avoid the inappropriate portion based on a detected result of the inappropriate portion detector and to avoid a collision with a re-fed recording sheet based on a detected result of the recording sheet detector, and controls the recording sheet feeding member so that the recording sheet is fed to the recording sheet transporting member so as to avoid the inappropriate portion based on a detected result of the inappropriate portion detector.

In the image forming apparatus, by setting an interval for supplying the recording sheets by the recording sheet supplying member to be shorter than that for feeding the recording sheets to the recording sheet transporting member by the recording sheet feeding member, slipping of the recording sheet caused when being fed can be compensated for so as not to affect the feeding of the recording sheet to the recording sheet transporting member. In addition, the recording sheet can be fed so as not to be located on an inappropriate portion as well as to avoid collision with a re-fed recording sheet.

According to still another aspect of the present invention, an image forming apparatus including a recording sheet supplying member which supplies a recording sheet placed on a recording sheet supply tray to a transporting path, a recording sheet transporting member which has an inappropriate portion not suitable for forming an image and transports a recording sheet while holding the recording sheet thereon, the recording sheet transporting member being endless, a recording sheet feeding member which feeds the recording sheet transferred from the recording sheet supplying member to the recording sheet transporting member, a circulation path in which the recording sheet is inverted and circulated in order to form an image on both sides of the recording sheet, and a controller which controls a feeding of the recording sheets so as to avoid the inappropriate portion for every number of the recording sheets which can be accommodated in a circumference of the recording sheet transporting member.

In the image forming apparatus, by controlling the feeding of the recording sheets so as to avoid the inappropriate portion of the recording sheet transporting member for every number of the recording sheets which can be accommodated in a circumference of the recording sheet transporting member, an efficient and simple control can be performed than the case where controlling the feeding of the recording sheets are performed for every different sizes. Concretely, for example, a position of an essentially longest recording sheet which can be transported to avoid the inappropriate portion on the recording sheet transporting member is previously determined for every number of the recording sheets which can accommodated in a circumference of the recording sheet transporting member. Thus, in a case where the same number of recording sheets of the other size are transformed, the recording sheets are transformed with their front edges aligned with the front edge of the essentially longest recording sheet.

According to yet another aspect of the present invention, an image forming apparatus includes a recording sheet supplying member which supplies a recording sheet placed on a recording sheet supply tray to a transporting path, a recording sheet transporting member which has an inappropriate portion not suitable for forming an image and transports a recording sheet while holding the recording sheet thereon, the recording sheet transporting member being endless, a recording sheet feeding member which feeds the recording sheet transferred from the recording sheet supplying member to the recording sheet transporting member, and a circulation path in which the recording sheet is inverted and circulated in order to form images on both sides of the recording sheet. The circulation path is designed so as to satisfy the condition;

$$L1+L2=N\times Ls+Li;$$

where

L1+L2 is a length of the circulation path excluding a recording sheet inverting unit;

Ls is a circumference length of the recording sheet transporting member;

Li is an interval of recording sheets; and

N is an integer.

In the image forming apparatus, a recording sheet inverted and circularly returned for copying the second side is not required unnecessarily to stop driving the transfer, resulting in an improved productivity.

It is preferable that N is set to be an even number. This can avoid generating useless spaces between the recording sheets, which further improves the productivity, even in a case where the number of recording sheets placed on the recording sheet transporting member is an odd number when the first and second sides are fed by turns.

Other objects and the features will be apparent from the following detailed description of the invention with reference to the attached drawings.

BRIEF DESCRIPTION OF THE DRAWINGS

The present invention will be more fully described and better understood from the following description, taken with the appended drawings, in which:

FIGS. 8(*a*)–8(*d*) are an explanatory view showing the positional relationships between the first sheet and the belt and between the second sheet and belt where two sheets of papers are accommodated in a circumference of the belt according to an embodiment of the present invention;

FIGS. 9(*a*)–9(*d*) are an explanatory view showing the positional relationships between the first sheet and the belt and between the second sheet and the belt where when a piece of paper is accommodated in a circumference of the belt according to an embodiment of the present invention;

FIGS. 10(*a*)–10(*d*) are an explanatory view showing the positional relationships between the first sheet and the belt and between the second sheet and the belt where the first sheet and the second sheet are fed by turns according to an embodiment of the present invention;

FIGS. 11(*a*)–11(*d*) are an explanatory view showing the positional relationships between the first sheet and the belt and between the second sheet and the belt when a letter-size paper disposed in the transverse direction of the belt is copied on both sides by copying one side and then the other side, under the condition that Li+L2=2×Ls+Li (letter Y), according to an embodiment of the present invention;

DETAILED DESCRIPTION OF THE PREFERRED EMBODIMENTS

Preferred embodiments of the present invention will now be described, in detail, with reference to the accompanying drawings.

<Construction of a Copying Machine>

Figure 1:
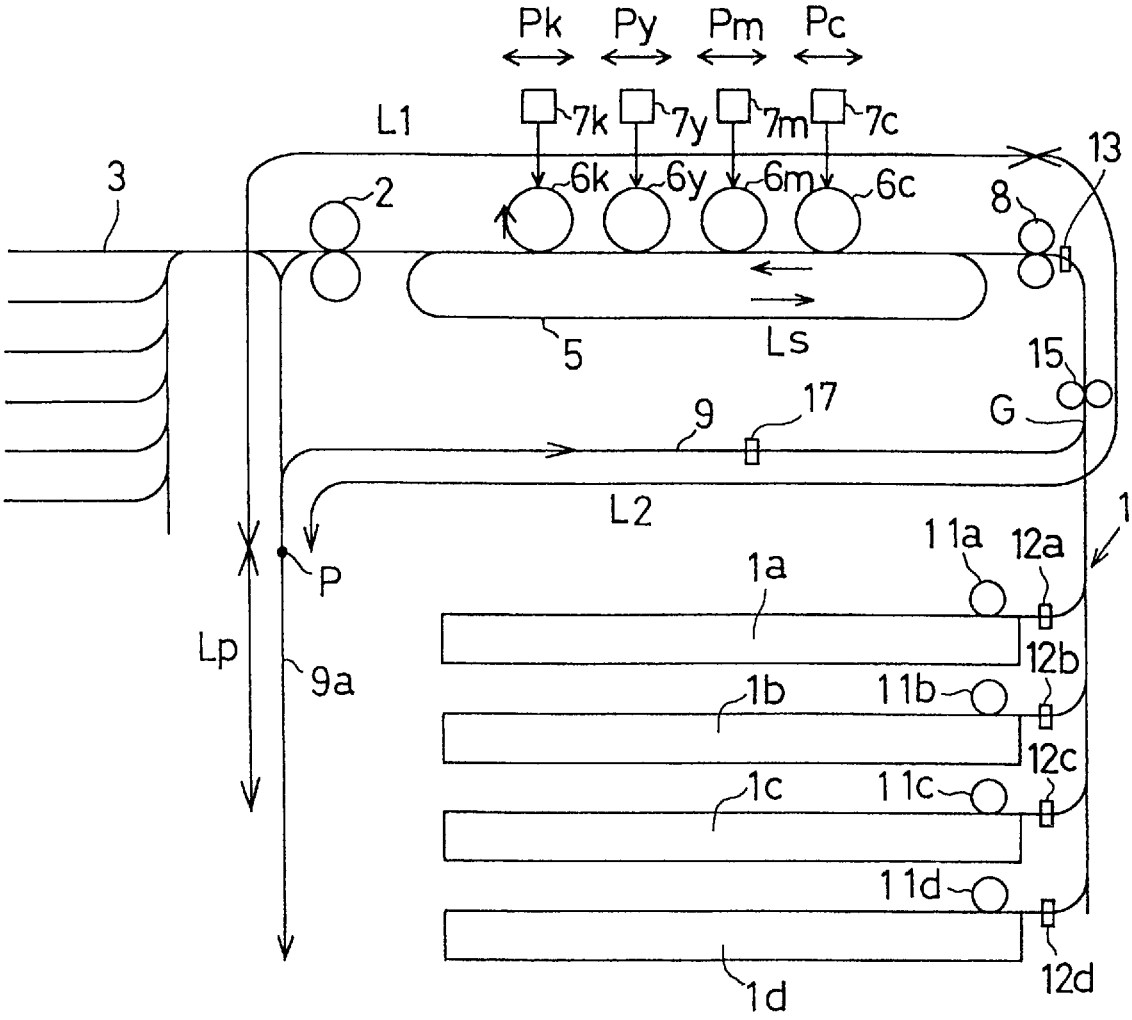
FIG. 1 is a schematic view of a major part of an image forming unit of a full color image forming apparatus according to an embodiment of the present invention.

FIG. 1 schematically shows a major part of an image forming unit of an electrophotography type full-color copying machine according to one embodiment of the present invention. The present invention can also be applied to various other types of image forming apparatus of electrophotography type, electrostatic recording type, or similar types, other than that of this embodiment.

The image forming apparatus includes four image forming units Pc, Pm, Py, Pk. Disposed below the image forming units is a paper-supply unit 1. At the left side of the image forming units A, a fixing device 2 is disposed. At the left side of the fixing device 2, a sorter 3 is disposed. The sorter 3 has functions such as stapling and tray-shifting.

Between the paper-supply unit 1 and the fixing device 2, a circulation path 9 which circularly conveys a paper as a recording sheet is formed. A paper inverting unit 9*a* for inverting and transferring a paper is provided in the circulation path 9 between the fixing device 2 and the paper-supply unit 1. The paper inverting unit 9*a* also serves as a changing device which changes a paper from being discharged toward the sorter 3 into being introduced into the circulation path 9 for copying the reverse side of the paper. At the downstream region of the paper inverting unit 9*a* in the circulation path 9, a paper detecting sensor 17 for detecting a paper re-transported into the circulation path 9 to be copied on the reverse side thereof is provided.

At the lower side of a transporting path between the paper supply unit 1 and the fixing device 2, an endless belt 5 for holding and transporting a paper is provided such that the belt is supported and tensioned by a plurality of rollers (not shown) in a well known manner.

The belt 5 is driven in the direction of the arrows shown in FIG. 1. The belt holds and transports a paper fed from the paper-supply supply unit 1 to each of the image forming units Pc, Pm, Py, Pk in order.

Each of the image forming units Pc, Pm, Py, Pk, each having substantially the same construction, respectively, includes photosensitive drums 6*c*, 6*m*, 6*y*, 6*k*, each driven to rotate in the direction of the arrow shown in FIG. 1. At around each photosensitive drum, well-known image forming elements (not shown) are disposed.

The above-mentioned image forming elements may be any desired structure. In this embodiment, an electrostatic charger for uniformly charging each photosensitive drum 6*c*, 6*m*, 6*y*, 6*k*, a developing device for developing electrostatic latent images formed on each photosensitive drum, a transferring charger for transferring a developed toner image on a paper, a cleaner for removing toner remaining on the photosensitive drum, are disposed around each photosensitive drum in the order in the rotational direction thereof. Image exposing devices 7*c*, 7*m*, 7*y*, 7*k* are provided, respectively, above the photosensitive drums 6*c*, 6*m*, 6*y*, 6*k*.

In the developing devices of the image forming units Pc, Pm, Py, Pk, cyan color toner, yellow color toner, magenta color toner and black color toner are stored, respectively.

Each image exposing device 7*c*, 7*m*, 7*y*, 7*k* comprises a semiconductor laser, a polygon mirror, an fθ lense, etc. In the image exposing device, a laser beam, which is modulated in accordance with electric digital image signals, scans in the longitudinal direction on each photosensitive drum 6*c*, 6*m*, 6*y*, 6*k*, at location between the electrostatic charger and the developing device to expose the drum surface, thereby forming an electrostatic latent image on each photosensitive drum. An image signal corresponding to a cyan color, a magenta color, a yellow color and a black color component of a color image is input into the respective image exposing device 7*c*, 7*m*, 7*y*, 7*k* of the respective image forming unit Pc, Pm, Py, Pk.

Between the image forming unit Pc and the paper-supply unit 1, a paper adhering member (not shown) is provided so that a paper fed from the paper-supply unit 1 is assuredly and electrostatically adhered by the belt 5. Between the image forming unit Pk and the fixing device 2, an erasing device (not shown) is provided to erase electrical charge to separate the paper adhering to the belt 5 therefrom.

The belt 5 is made of a resin film sheet having a semiconductor (or conductor) characteristic with opposite ends connected by melting, or the like, to create an endless belt. The belt 5 is endlessly driven at a constant velocity in the direction of the arrow by a driving roller (not shown). A seam of the belt is regarded as an inappropriate portion for an image forming because the seam portion is different in thickness from the remaining portion, and thus exercises a harmful influence on copying or printing an image onto a paper from the photosensitive drums 6*c*, 6*m*, 6*y*, 6*k*. Accordingly, as will be mentioned later, when a paper is fed to the belt 5, control is required such that a paper is fed so as not to be located on the seam, or that only a certain region of a paper is located on the seam during a special situation.

The paper-supply unit 1 comprises a plurality of paper-supply trays (for example, cassette type trays) 1*a*, 1*b*, 1*c*, 1*d* for storing different size papers, paper-supply rollers 11*a*, 11*b*, 11*c*, 11*d* each comprising a paper-supply member for supplying a paper one by one from each paper-supply tray 1*a*, 1*b*, 1*c*, 1*d*, paper feed sensors 12*a*, 12*b*, 12*c*, 12*d* each for detecting a paper supplied from each paper-supply tray 1*a*, 1*b*, 1*c*, 1*d*, a timing roller 8 as a feeding member for feeding a paper supplied from each paper-supply tray 1*a*, 1*b*, 1*c*, 1*d* onto the belt 5 at a certain time, a timing sensor 13 disposed adjacent to the timing roller 8 at an upstream position and intermediate rollers 15 which are disposed at an upstream position of the timing roller 8 and transfer a paper supplied from the paper-supply tray 1*a*, 1*b*, 1*c*, 1*d* or a paper copied on one side and returned on the circulation path 9 to the timing rollers 8.

The timing rollers 8, the intermediate rollers 15 and the paper-supply rollers 11*a*, 11*b*, 11*c*, 11*d* are driven by driver (not shown) such as a driving motor, a belt or gears.

In the full color copying machine shown in FIG. 1, when a paper is transported from the timing rollers 8 onto the belt 5 while being guided by a paper transport guide (not shown), the paper is assuredly electrostatically adhered to the belt 5 as a result of the effect of the paper adhering member. With the movement of the belt 5 in the direction of the arrows shown in FIG. 1, a visible image of cyan color (C) is formed on the photosensitive drum 6*c* of the image forming unit Pc, a visible image of magenta color (M) is formed on the photosensitive drum 6*m* of the image forming unit Pm, a visible image of yellow color (Y) is formed on the photosensitive drum 6*y*, of the image forming unit Py, and a visible image of black color (K) is formed on the photosensitive drum 6*k*, of the image forming unit Pk, each visible image being formed separately. These visible images are transferred, one on another, onto a paper by the transferring charger of each image forming unit Pc, Pm, Py, Pk, in that order, when the paper passes under the photosensitive drum 6*c*, 6*m*, 6*y*, 6*k*, of each image forming unit Pc, Pm, Py, Pk, in that order, toward the fixing device 2, in accordance with the movement of the belt 5, resulting in a composite color image. After the paper has passed the image forming unit Pk, the charged electricity of the paper is removed by the erasing device. Then the paper is detached from the belt 5. The paper detached from the belt 5 is discharged to the sorter 3 after the transferred multiple composite images are fixed by the fixing device 2.

In a case where the reverse side of the paper also is to be copied for a two-sided copy, the paper is inverted at the paper inverting unit 9*a* without discharging to the sorter 3 and then transported to the circulation path 9. An image forming onto the reverse side of the paper is performed in the same way as mentioned above, and then the paper is discharged to the sorter 3.

Thus, one series of a copying cycle is completed.

Figure 2:
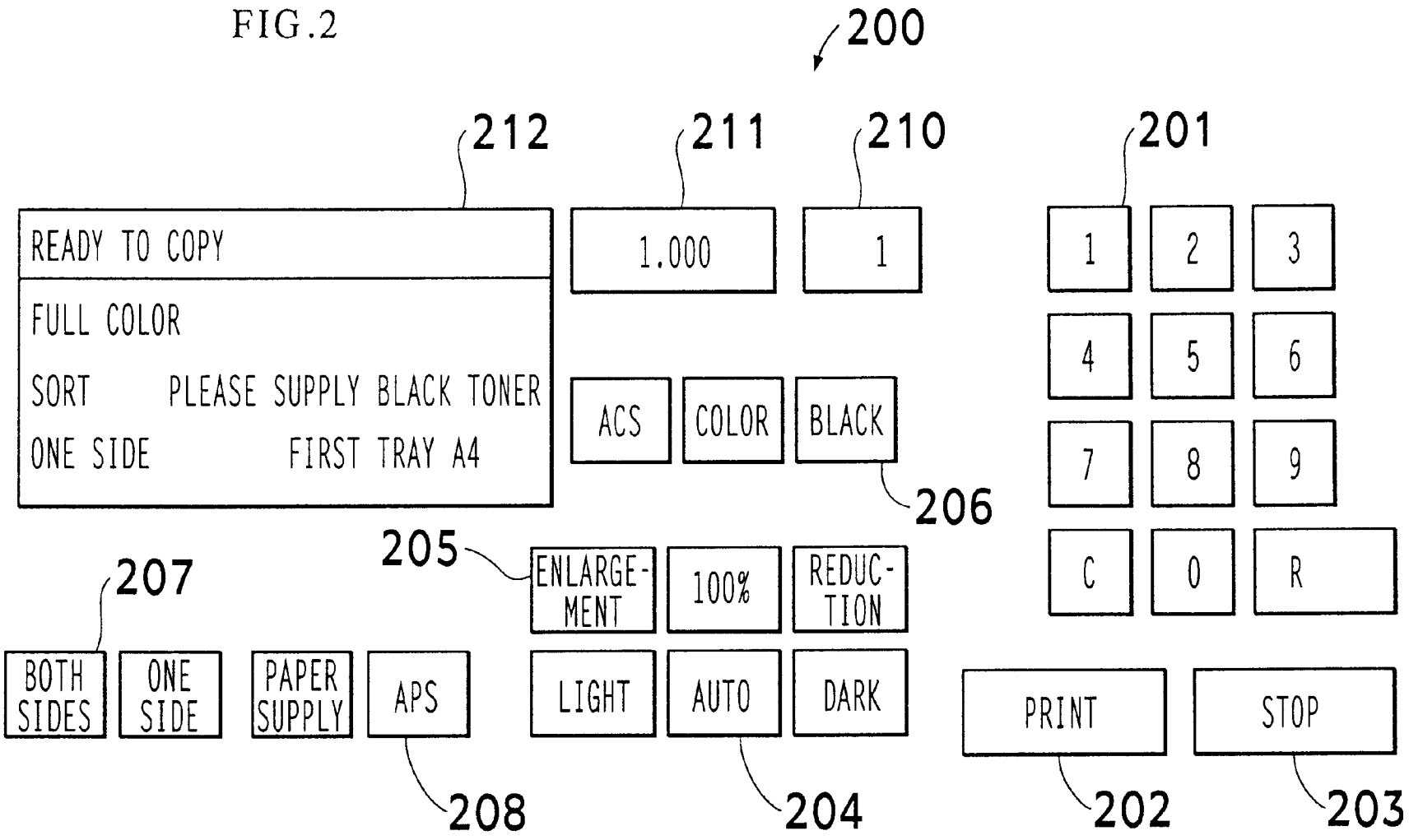
FIG. 2 is a plan view showing a portion of an operation panel according to an embodiment of the present invention.

FIG. 2 shows a part of the operation panel 200 of the full color copying machine shown in FIG. 1. This operation panel 200 enables the user to select a certain copy mode from various copy modes, start copying and recognize the set copy mode and the condition of the apparatus from the display.

A copy number setting unit 201 includes a plurality of keys for setting number of copies to be made and clearing the set number.

A key 202 marked as 'PRINT' is used to start copying. A key marked as 'STOP' is used to stop a copying operation. Darkness setting keys 204 are used to adjust the darkness of the image to be copied. Reduce/enlarge rate setting keys 205 are used to set a reduce/enlarge rate of the image to be copied. Color mode selecting keys 206 are used to set whether the image to be copied is printed in full color or only in black.

Copy side selection keys 207 are used to set whether the image to be copied is printed on one side of a paper or on both sides thereof. Tray select keys 208 are used to select one of four paper-supply trays.

A copy number display unit 210 displays number of copies to be made before the copy operation and number of remaining copies during the copy operation. A reduce/enlarge rate display unit 211 displays the set rate. A liquid crystal display unit 212 is a multi-purpose display unit which displays the set copy mode, the status of the apparatus and various information other than the information of the number of papers or the reduce/enlarge rate.

Figure 3:
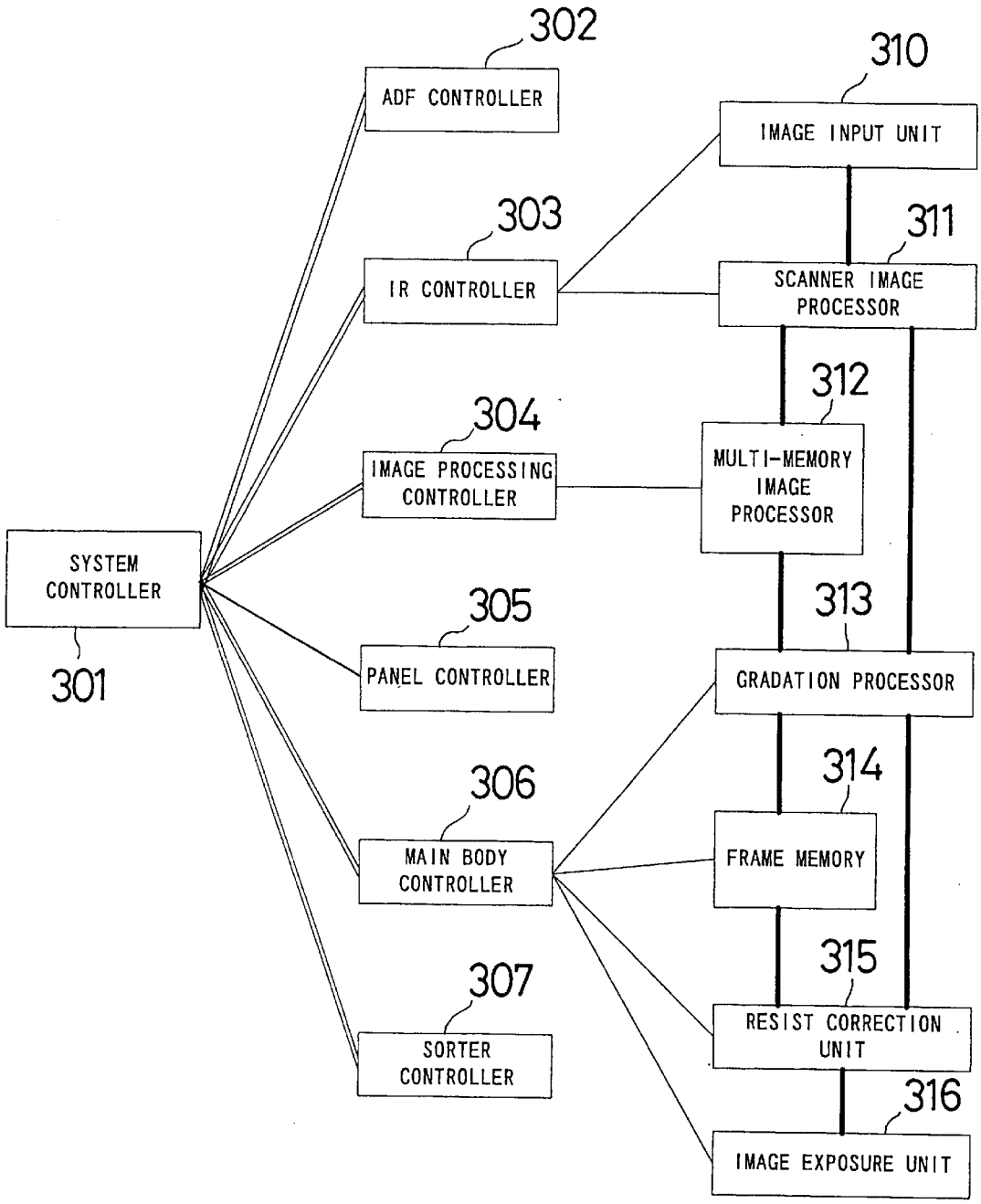
FIG. 3 is a block diagram showing a control of the whole apparatus according to an embodiment of the present invention.

FIG. 3 is a block diagram showing an overall control of a full color copying machine, such as the one shown in FIGS. 1 and 2.

The full color copying machine includes an image reader (IR) for reading an image information of a document as a function of a copying machine, an automatic document feeder (ADF) for automatically feeding a document one by one to an image reading unit of the image reader, in addition to the image forming main unit and the panel unit described in detail with FIGS. 1 and 2. However, the construction of the machine is not limited to the above.

A system controller 301 is a control unit which controls the whole copying machine.

An ADF controller 302 is a control unit which controls the automatic document feeder such that documents are fed one by one to the image reading unit of the image reader and are discharged to a document discharge unit after the completion of the reading of the images.

An IR controller 303 is a control unit for controlling the scanning velocity and position of a scanner for reading an image of a document.

An image processing controller 304 is a control unit which operates a multi-memory image processor 312 depending on a copy sequence or a copy mode. Concretely, the image forming processing controller 304 controls the recording of an image signal processed by a scanner image processor 311 for every one page of the documents. Further, the image processor controller 304 controls the selecting of an image signal of the document saved for every one page in the order depending on a copy sequence, etc. and the sending of the saved image signal to a gradation processor 313. Furthermore, the image processing controller 304 controls a rotation of an image by 90 degrees or 180 degrees depending on a copy mode, etc.

A panel controller 305 is a control unit which processes and displays key inputs of the operation panel 200 as described with FIG. 2.

A main body controller 306 is a control unit which controls the transportation of papers, the belt 5, the photosensitive drums 6*c*, 6*m*, 6*y*, 6*k*, the image forming elements disposed around the drums, the fixing device 2, etc., described in connection with FIG. 1. A more detailed explanation will be given later.

A sorter controller 307 is a control unit which controls the discharge of the papers in the sorter 3, the movement of bins, the position of the shift tray and the stapling operation.

An image input unit 310 includes a sensor unit comprising CCD and the like for reading an image of a document, a circuit unit which digitalizes the signal from the sensor unit. In this embodiment, each component of the color image C, M, Y and K is processed at the same time.

The scanner image processor 311 includes a circuit for reducing/enlarging, shifting, erasing the digitalized image signal depending on a copy mode, etc.

The multi-memory image processor 312 includes a memory for storing image information and a circuit for rotating or reducing/enlarging an image.

The gradation processor 313 includes a circuit which converts the tone data, for example, from eight tones to three tones, corresponding to a circuit.

A frame memory 314 includes a circuit which temporarily stores image signals of a plurality of pages when copying both sides and outputs an image signal of a required page at a required time.

A resist correction unit 315 includes a circuit which delays the image signals corresponding to each C, M, Y and K composition of the color image by a time corresponding to a timing gap of the paper passing below the image forming units Pc, Pm, Py, Pk in the order. By this circuit, the image signal of each C, M, Y and K component can be processed at the same time between the image input unit 310 and the gradation processor 313 or the frame memory 314.

The image exposure unit 316 corresponds to the reference to numerals 7*c*, 7*m*, 7*y*, 7*k* shown in FIG. 1, and comprises a circuit which forms an electrostatic latent image of each C, M, Y and K component on the respective photosensitive drums 6*c*, 6*m*, 6*y*, 6*k*, in response to a corresponding image signal.

<Paper-feed Control by Timing Rollers 8>

The control operation for feeding papers to the image-transfer belt (referred to simply as the belt) at a predetermined time by timing rollers 8 will be described.

In this invention, the paper-feed timing is determined so that the paper is not positioned on the seam of the belt. In other words, the paper which has been transported to the timing rollers 8 is fed to the belt so that the paper does not cover the seam of the belt. This paper-feed timing is determined based on the position of the seam and the paper size (or the image size).

Figure 4:
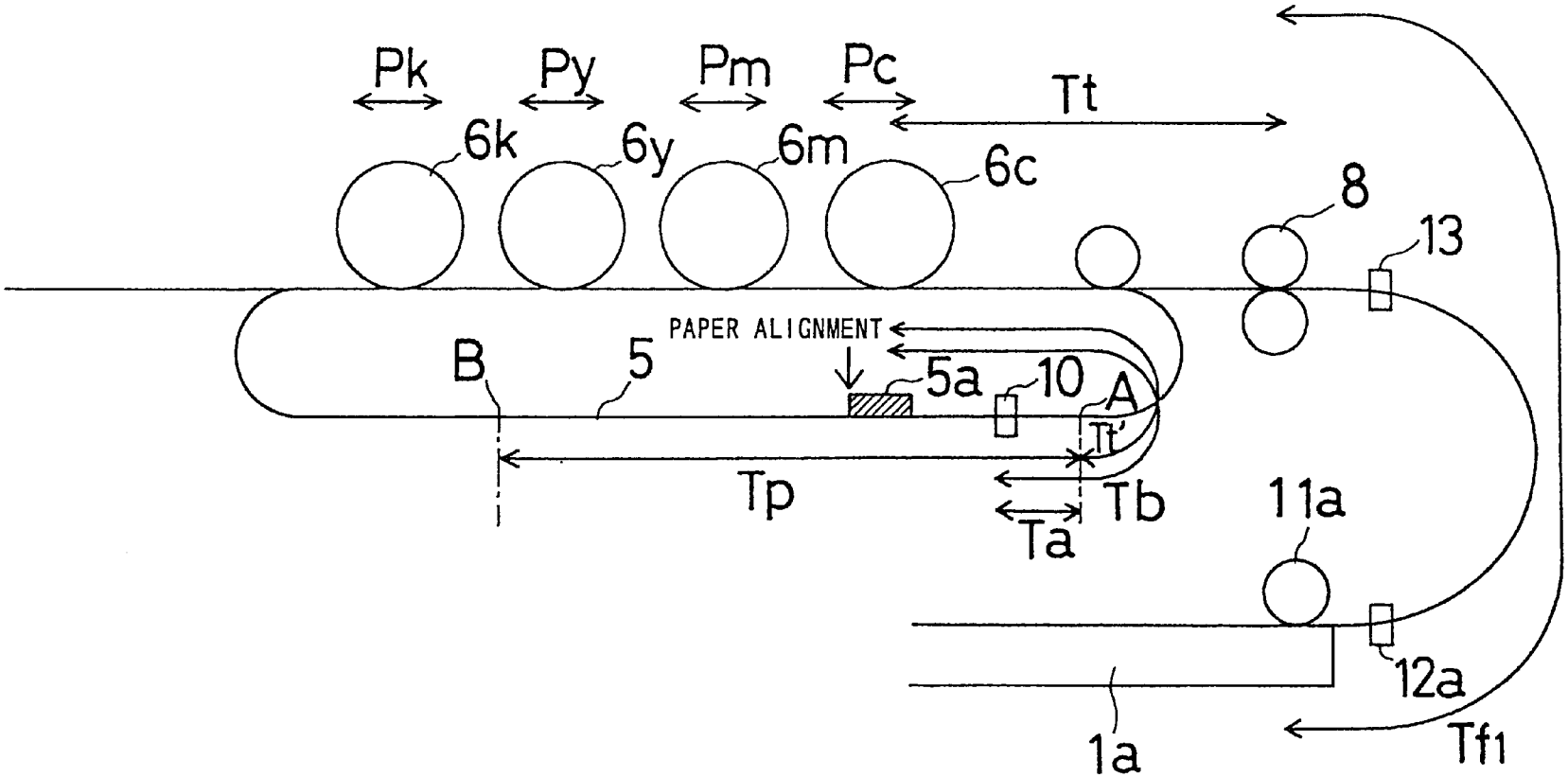
FIG. 4 is a schematic view of timing rollers, an image-forming belt and therearound according to an embodiment of the present invention.
Figure 5:
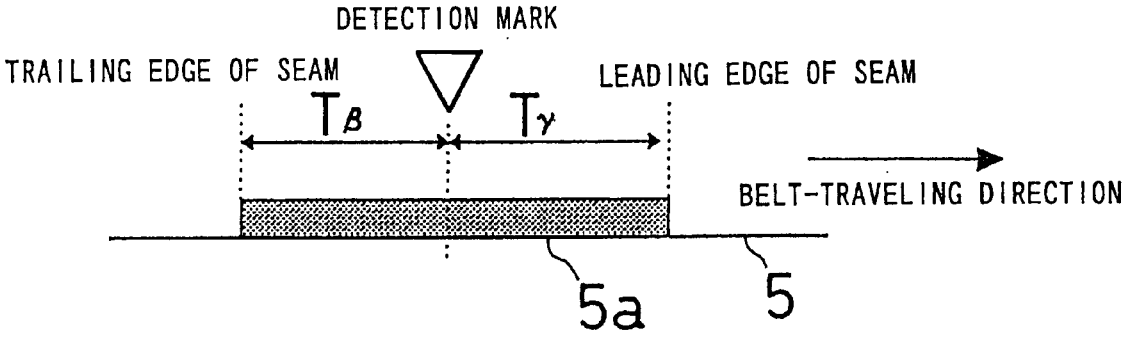
FIG. 5 is an explanatory view showing a seam portion of the belt according to an embodiment of the present invention.

FIG. 4 illustrates the structure around the timing rollers 8 and the belt 5. As shown in FIG. 4, a seam detection sensor 10 for detecting the seam 5*a* of the belt 5 is positioned on the upper stream of the photosensitive drum 6*c* along the traveling direction of the belt 5. When the seam detection sensor 10 detects the seam 5*a*, it generates an image-data request signal, which is supplied to the image processing circuit. If the time required for transporting the paper from the timing rollers 8 to the photosensitive drum 6*c*, which is provided in the first image forming unit Pc, is Tt, and if the time from the generation of the image-data request signal to the actual start of paper-feeding by the timing rollers 8 plus extra time is Ta, then the seam detection sensor 10 is placed at a position defined by time Tb which is sum of Tt' and Ta (Tb=Tt'+Ta), where Tt'=Tt.

Accordingly, if time Ta has passed since the detection of the seam 5*a* by the seam detection sensor 10, (that is, if the seam 5*a* has reached point A shown in FIG. 4), the timing rollers 8 are driven to feed the paper onto the image-transfer belt 5, whereby the leading edge of the paper is aligned with the seam 5*a*. It should be assumed that the width of the seam 5*a* of the belt is infinitesimally small, and that the position of the seam 5*a* is coincident with the reference position for the leading edge of the paper.

If the time defined by (length of the paper)/(system speed) is Tp, and if the point at the upper stream from point A by time Tp is point B, then the paper-feed from the timing rollers 8 to the belt 5 is performed only when the seam 5*a* of the belt 5 does not exist in the section from B to A. This is the principle idea of the paper-feed control of this invention. Thus, point A corresponds to a time at which the leading edge of the paper aligns with the seam 5*a*, while point B corresponds to a time at which the trailing edge of the paper aligns with the seam 5*a*. If the paper is fed to the belt 5 with the seam 5*a* located in the section from point B to point A, the paper will be positioned on the seam 5*a*.

If the time elapsed from the detection of the seam 5*a* by the seam detection sensor 10 is t, t must satisfies inequality (1) in order for the seam 5*a* not to exist in the section from point B to A (i.e., in order for the seam 5*a* to be located in the section from point A to B):

$$Ta<t<Ts-Tp+Ta \quad (1)$$

where Ts is the time required for one revolution of the belt 5, and the range of Tp is from 0 to Ts.

In actual process, the seam 5*a* has a certain width, and this width is converted to time Tw, which is defined as Tw=Tβ+Tγ, where Tγ represents time required for the paper to move from the detection mark to the leading edge of the seam 5*a*, and Tβ is time required for the paper to move from the trailing edge of the seam 5*a* to the detection mark. Tβ and Tγ are determined so that the resultant image is not affected by the seam 5*a*.

Taking Tβ and Tγ into account, inequality (1) becomes $$Ta+T\beta<t<Ts-(Tp+T\gamma)+Ta \quad (2)$$

which is further rewritten as $$0<t-(Ta+T\beta)<Ts-Tp-Tw \quad (3)$$

If the paper is fed from the timing rollers 8 when t satisfies inequality (2) or (3), the paper does not overlap the seam 5*a*. Therefore, the paper-feed timing is controlled so that the paper is fed onto the belt 5 from the timing rollers 8 only when t satisfies inequality (2) or (3).

The above is the basic explanation for the paper-feed control operation for avoiding the paper positioned on the seam 6*a* of the belt 5. However, in the actual operation, other factors should be considered.

In order to maintain the quick imaging efficiency, the position of the seam detection sensor 10 is determined so as to satisfy $$Tt+Ta<Tb<Tf1$$

where Tf1 is time required from the initial paper supply to the formation of the loop. The image-transfer belt 5 is controlled such that the seam 5*a* is located at the position satisfy Ts−t<Tf1 when the belt 5 stops. Then, the belt 5 is driven again to feed the next paper immediately after the previous paper passed through the seam 5*a*. (That is, the belt 5 is driven again when Tf1−(Ts−t) has elapsed since the start of the paper feed.)

In order to achieve these control operations, the belt 5 should be driven at a constant speed for time t.

If the seam 5*a* of the belt 5 appears earlier than the expected time, due to, for example, delay in paper transportation or fluctuation in the belt stop position, then, it is preferable that the belt 5 is rotated one more revolution without feeding the next paper if in the fast imaging mode.

If the sorter has troubles in continuously ejecting papers due to, for example, a temperature change in image fixation, it is preferable that this information is added to the paper-feed timing control operation. In this case, the interval between papers positioned on the belt 5 is increased.

In general, the paper-transport speed can be changed according to the types of papers (e.g., ordinary paper, OHP, thick paper, etc.). It is also preferable to control and adjust the interval of papers according to the change in the paper-transport speed.

In order to avoid an image-memory phenomenon, in which a latent image formed on the photosensitive drum remains as an electrostatic image on the photosensitive drum and adversely affects the next image forming process, it is preferable to leave a space between papers by a distance corresponding to one revolution of the photosensitive drums 6*c*, 6*m*, 6*y*, and 6*k*. It is also preferable to set the paper ejection interval greater than a predetermined value when ejecting small-sized paper to the sorter. To prevent the image-memory phenomenon, a series of steps including charging, exposure, and erasing are performed over one revolution of the photosensitive drum.

Next, the control operation in two-sided imaging will be explained.

The paper-feed operation must be controlled so that the inverted and circulated paper is positioned so as not overlap the seam 5*a* of the belt 5. However, if the paper-feed interval is unnecessarily increased, the productivity decreases.

In order to perform two-sided imaging without reducing productivity, while avoiding the seam position, the circulation path is designed so as to satisfy the condition $$L1+L2=N\times Ls+Li(\text{Letter } Y)$$

where

L1 is the distance from the timing rollers 8 to the inversion point P in the circulation path 9;

L2 is the distance from the inversion point P to the timing rollers 8 in the circulation path 9;

Ls is the total length of the image-transfer belt 5;

Li (Letter Y) is the paper interval on the belt for a letter-size paper fed in the transverse direction; and N is a natural number.

The inversion point P is a point at which the paper which has been fed from the fixing rollers 2 is stopped so that the trailing edge of the paper is located at point P, and the feeding direction is then changed. Accordingly, the trailing edge of the paper becomes the leading edge by the inversion at point P.

In order to simplify the explanation, the case where N=3 will be explained. In this example, the total length Ls of the belt 5 is set so as to satisfy equation Ls=3×[Lp(Letter Y)+Li(Letter Y)], where Lp is the length of the shorter side of the letter size paper fed in the transverse direction, and Y stands for the transverse feeding. This equation is disclosed in Japanese Unexamined Laid-Open Patent Publication No. H6(1994)-35261, and it defines the efficient use of the belt when continuously feeding letter-size papers onto the belt. N=3 represents that three letter-size papers are to be positioned on the belt with their longer axes perpendicular to the belt-traveling direction.

The paper returned to the timing rollers 8 for the imaging on the back face is temporarily paused immediately before the timing rollers 8 for purposes of skew correction. If this temporary pause is too long, the paper which has already been fed to the fixing rollers 2 will collide with the downstream paper because the paper being fed from the timing rollers 8 to the fixing rollers 2 can not be stopped. Therefore, the number of papers kept in the two-sided imaging path is limited to ½, which decreases the productivity.

In order to increase the productivity, time interval for the temporary pause must be set minimum, while keeping the optimal paper interval.

To achieve this, the circulation path must satisfy the following two conditions.

(1) The total length of the circulation path must be set so that the paper which has been inverted and transported to the timing rollers 8 is smoothly fed from the timing rollers 8 only after a short pause for the skew correction; and (2) The paper-supply interval must be controlled during the imaging on the front surface such that the subsequently inverted and returned paper is only temporarily paused at the timing rollers 8 for the skew correction.

To be more precise, an image is formed on one face of each of a set of papers accommodated in the circulation path 9 and, then, another image is formed on the other face of each of the same set of papers. In this situation, the length of the circulation path 9 must be determined so that the paper mounted on the belt 5 at a position directly after the seam 5*a* is circulated in the two-sided imaging circulation path 9 and is again mounted on the belt 5 at the same position directly after the seam 5*a*. In order to achieve this, the length of the circulation path 9 (L1+Lp+L2) is set N times as long as the length of the belt 5, where N is a natural number. However, since the length of the circulation path 9 changes depending on the paper size (i.e., the value of Lp), it is impossible to satisfy the above-mentioned condition for all types of papers. It is also difficult to realize an apparatus which is capable of changing the length of the circulation path according to the paper size so that the length of the circulation path is always an integer multiple of the length of the belt 5.

Figures 6A, 6B, 6C, 6D, 6E, 6F:
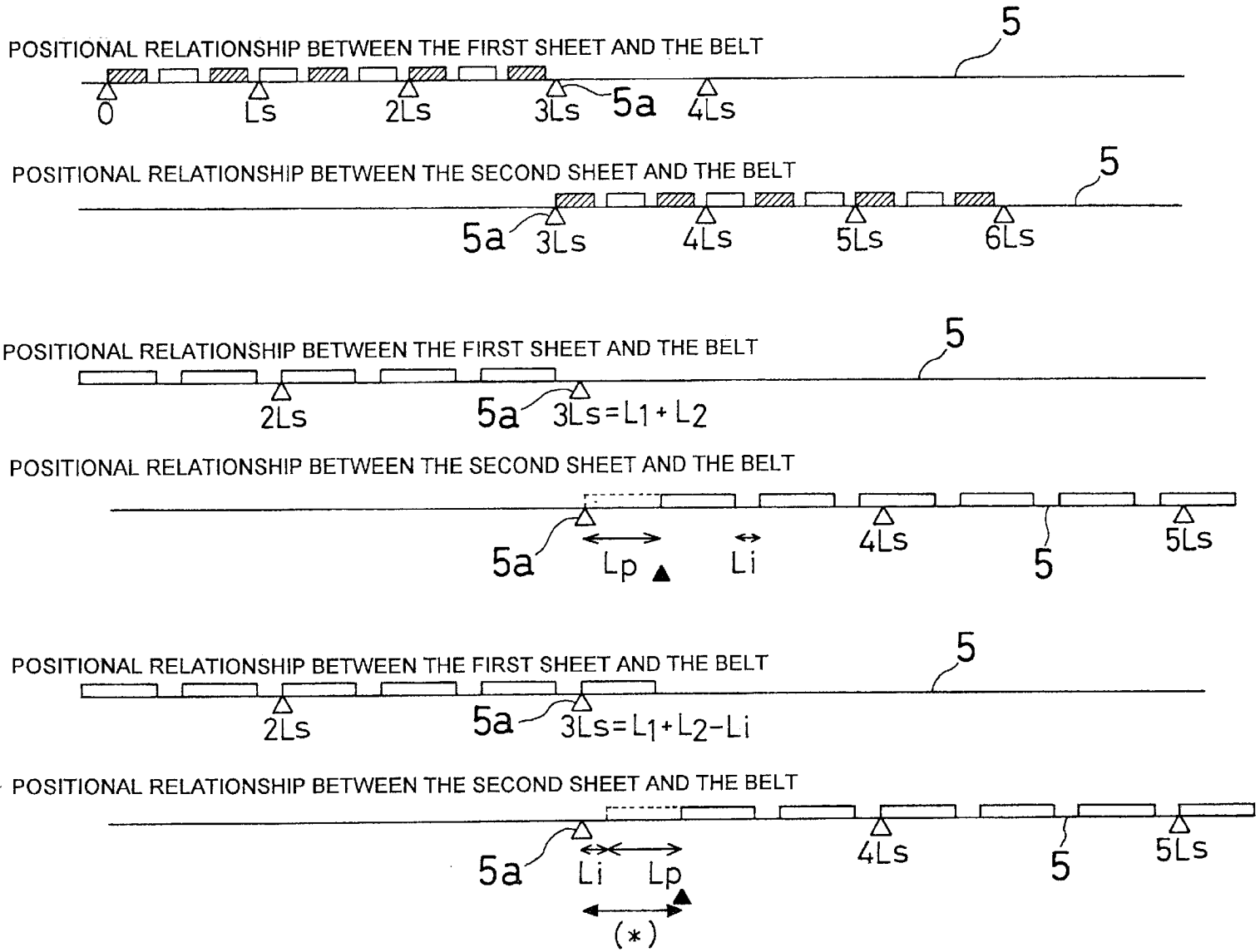
FIGS. 6(*a*)–6(*f*) are an explanatory view showing the positional relationships between the first sheet and the belt and between the first sheet and the belt where three sheets of papers are accommodated in a circumference of the belt according to an embodiment of the present invention.

Focusing on the factor L1+L2 which is independent of the paper size among the circulation path 9, if the length (L1+L2) is simply set to a multiple of an integer of the length of the belt 5 without considering the paper size, the paper which has been transported through the circulation path 9 for copying on its back-side (hereinafter referred to as back-side paper) is positioned on the belt 5 at a position shifted behind the seam 5*a* by the width Lp of the paper, as shown in FIGS. 6(*c*) and 6(*d*).

In FIG. 6(*d*), the darkened triangle indicates the position of 3×Ls+Lp, which equals the circulation path length itself. If 3×LS=L1+L2−Li is satisfied as shown in FIGS. 6(*e*) and 6(*f*), the positional relation between the belt 5 and the paper is kept constant for the front face and the back face of the paper. This means that the paper that has been transported through the circulation path 9 is again placed on the belt 5 avoiding the seam 5*a*, without an unnecessary pause.

The factor Lp, which is dependent on the paper size, is absorbed by the distance (*) indicated in FIG. 6(*f*), which is between the seam 5*a* and the leading edge of the back-side paper. Therefore, Lp can be corrected by adjusting the positional relationship between the belt 5 and the back-side paper in circulation path 9. The total length of the two-sided imaging circulation path 9 is L1+Lp+L2, and Lp is added because the leading edge and the trailing edge of the paper are changed. Lp, which is dependent on the paper-size, corresponds to the distance (*) between the seam 5*a* and the back-side paper. Therefore, by simply varying the length (*), the positional relationship between the belt and the paper can be maintained constant between the front-side and back side paper.

However, the paper interval Li, which is provided for the front-side imaging for purposes of avoiding the seam 5*a*, is not constant for all papers. Accordingly, the paper-supply interval must be controlled taking into account the paper interval for the back-side imaging.

Now, some consideration will be made on the paper interval Li using examples of most frequently used paper, that is, letter-size paper and A-4 paper.

In this embodiment, the total length of the belt 5 is 960.47 mm. If letter-size paper or A-4 paper is positioned in the transverse direction (with the width along the belt traveling directions), three papers can be placed on this belt. Since the width of letter-size paper is greater than that of A-4 paper (with less paper interval), letter-size paper will be used as a basic example.

If three letter-size papers are placed on the belt at a constant interval, the paper interval is defined as $$Li(\text{Letter } Y)=(Ls/3)-Lp$$

where Li (Letter Y) is an average interval between two subsequent letter-size papers on the belt. Since the paper is temporarily paused for skew correction prior to imaging on the back face, the paper interval is reduced during the pause. At this time, a minimum necessary interval must be ensured.

It is assumed that the circulation path length is set so as to satisfy the relation L1+L2=N×Ls+Li (Letter Y) for the following explanation.

Figures 7A, 7B:
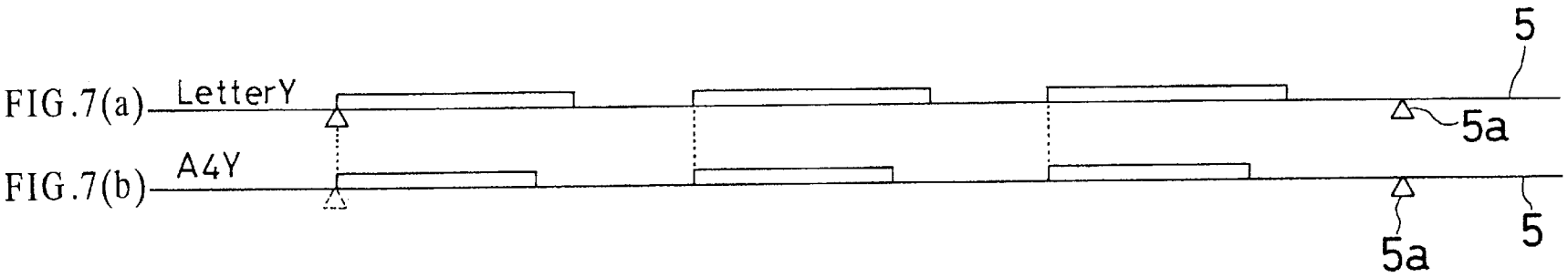
FIGS. 7(*a*)–7(*b*) are an explanatory view showing the positional relationships between a letter-size paper and an A4-size paper, each disposed in the transverse direction of the belt according to an embodiment of the present invention.

The paper interval for A-4 paper is set slightly larger than that for letter-size paper in order to make the paper-feed of A-4 paper equivalent to paper-feed of letter-size paper, as shown in FIGS. 7(*a*) and 7(*b*). In other words, A-4 papers are placed in the transverse direction on the belt 5 so that the leading edge of A-4 paper aligns with the leading edge of letter-size paper. The paper interval for A-4 paper is defined as follows.

$$Li(\text{A4Y})=Li(\text{Letter } Y)+(297\text{ mm}-11\text{ inches})$$

This relation can be applied to other sizes of papers, as long as three papers can be placed in the transverse direction on the transfer path. Accordingly, if the position of the leading edge of the widest paper is determined so that both sides of that paper do not overlap the seam 5*a*, other sizes of papers can also be correctly fed by simply adjusting the paper interval and bringing the leading edge of each paper to the predetermined position. Thus, the paper-interval control operation is simplified.

Next, another example, in which two papers (letter size or A4) are placed in the longitudinal direction on the belt, will be explained. The length of A-4 paper is longer than that of letter-size paper. Accordingly, the reference paper interval is determined using A-4 paper as a basic paper.

As shown in FIGS. 8(*a*) and 8(*b*), two A-4 papers A and B are placed on the belt 5 with an interval Li1. The leading edge of paper A is positioned directly after the seam 5*a*. The distance from the second paper B to the next seam 5*a* is Li2. These intervals Li1 and Li2 are expressed as follows.

$$Li1=Ls-[(Lp(\text{A4T})+Li(\text{Letter}Y))+Lp(\text{A4T})]$$

$$Li2=Ls-(Lp(\text{A4T})+Li1+Lp(\text{A4T}))=Li>Li(\text{min})+L(\text{loop})$$

where (A4T) represents A-4 paper placed with its longitudinal axis along the belt traveling direction.

FIGS. 8(*c*) and 8(*d*) illustrate another example. In this case, the distance from the seam 5*a* to the leading edge of paper 1 is Li0, the distance from the trailing edge of paper A to the leading edge of paper B is Li1, the distance from the trailing edge of paper B to the next seam 5*a* is Ly, and the distance from the trailing edge of paper B of the leading edge of next paper A is Li2. Then, the following relations are satisfied.

$$Li1=Li2=Ls/2-Lp(\text{A4T})$$

$$Li0=Ls/2-(Lp(\text{A4T})+Li)\ Ly=Li2-Li0=Li>0$$

By controlling the paper interval in this manner, the back-side paper can be fed onto the belt avoiding the seam 5*a* during the two-sided imaging operation.

The same applies to letter-size papers or other sizes of papers as long as the length (i.e., the long side) of such paper is less than half (½) of the belt length. Once the position of the leading edge of A-4 paper placed in the longitudinal direction is determined so as to avoid the seam, other sizes of papers can also be correctly fed by simply aligning the leading edge of each paper with the A-4 leading edge. However, the arrangement shown in FIGS. 8(*c*) and 8(*d*) is not capable of feeding different sizes of papers, an an alternate manner.

FIGS. 9(*a*) and 9(*b*) illustrate still another example. In this case, only one paper having dimensions of 11×17 inches or A-3 paper is placed in the longitudinal direction on the belt, will be explained. The length of 11×17 inches paper is greater than that of A-3 paper and, accordingly, the reference paper interval is determined using 11×17 inches paper as a basic paper.

As shown in FIG. 9(*a*), if front-side paper is fed to the belt so that its leading edge is positioned directly after the seam 5*a*, the back-side paper, which has been circulated in the two-sided imaging circulation path, overlaps the seam 5*a*. In this case, the distance from the trailing edge of the back-side paper to the next seam 5*a* is indicated by symbol Lx, as shown in FIG. 9(*b*). Lx is represented by the following equation.

$$Lx=Ls-[(Lp(11\times17\text{T})+Li(\text{Letter}Y))+Lp(11\times17\text{T})]$$

Since the actual value of Li (Letter Y) is 104.26 ((960.47/3)−8.5×25.4=104.26), the actual value of Lx becomes $$Lx=960.47-[(17\times25.4+104.26)+17\times25.4]=960.47-967.86=-7.39<0$$

The negative sign of the Lx value means that the back-side paper overlaps the seam 5*a*.

In order to avoid this situation, the front-side paper is fed to the belt 5 with a distance Ly from its leading edge ahead of the N seam 5*a*, as shown in FIGS. 9(*c*) and 9(*d*), such that the leading edge of the back-side paper is positioned directly after the seam 5*a*.

$$Ly=Ls-(Lp(11\times17\text{T})+Li(\text{Letter}Y))$$

The distance Lx from the trailing edge of the front-side paper to the next seam 5*a* is expressed by $$Lx=Ls-(Ly+Lp(11\times17\text{T}))=Ls-[Ls-(Lp(11\times17\text{T})+Li(\text{Letter }Y))+Lp(11\times17\text{T})]=Li>0$$

Since Lx is positive, the trailing edge of the front-side paper will not overlap the next seam 5*a*.

The same thing applies to A-3 paper or other sizes of papers which can be totally accommodated in the belt path. Once the position of the leading edge of 11×17 inches paper placed in the longitudinal direction is determined so as to avoid the seam, other sizes of papers can also be correctly fed by simply aligning the leading edge of each paper with the predetermined position.

As has been described, a set of papers which can be accommodated in the belt path are comprehensively controlled so that none of the papers overlap the seams 5*a* of the belt 5. Concerning similar sizes of papers, the paper having a maximum length along the belt-traveling direction is used as a reference, and other similar papers are fed to the belt so that their leading edges align with the prescribed position determined by the reference paper, whereby both the front-side and the back-side papers can be correctly fed without overlapping the seams 5*a*.

In the above explanation, the paper interval Li is calculated from three letter-size papers placed in the transverse direction on the belt 5, and the position of the front-side paper is determined based on this Li(letter Y) value. However, the invention is not limited to this example.

So far, images are continuously formed on the front-sides of a set of papers which can be accommodated in the belt path and, subsequently, other images are formed on the back sides of that set of papers. In the next example, images are formed on the front side and the back side of a paper alternately for each paper which is circulated in the two-sided imaging circulation path.

In order to insert the back-side imaging operation between two subsequent front-side imaging operations, the paper-supply interval must be controlled so that an image is formed on the back-side of the current paper before the next paper is supplied to the belt.

FIGS. 10(*a*)–10(*d*) illustrate the two-sided imaging operation of this example. Three letter-size papers are accommodated in the belt path in the transverse direction with an paper interval of Li(Letter Y).

$$Li(\text{Letter }Y)=((Ls/3)-Lp)\times2+Lp(\text{Letter }Y)$$

The front-side paper is circulated in the two-sided imaging circulation path after the imaging with an interval of Li, and is fed onto the belt again for the imaging on the back side. At this time, next front-side paper must be inserted immediately onto the belt before the current back-side paper.

However, if an odd number of (three, in this example) letter-size papers are placed in the transverse direction on the belt 5 (that is, L1+L2=N×Ls+Li (Letter Y), where N=3), there is not sufficient space to insert a paper between the previous front-side paper 50*a* and the current back-side paper 50*b*, as shown in FIGS. 10(*a*) and 10(*b*). This contracts the alternate paper feeding.

In order to correctly place the next paper before the current back-side paper comes back to the belt 5, an extra paper interval must be provided between the previous front-side paper and the back-side paper. This causes the productivity to decrease.

In contrast, if N is an even number in equation L1+L2=N×Ls+Li (Letter Y), as shown in FIGS. 10(*c*) and 10(*d*), it is not necessary to provide extra space between the last front-side paper 50*a* and the next back-side paper 50*b* and, therefore, front-side papers and back side papers are alternately fed onto the image-transfer belt at a constant interval. The productivity can be maintained.

This also applies to other sizes of papers.

FIGS. 11(*a*) and 11(*b*) illustrate an example, in which L1+L2=2×Ls+Li (Letter Y) is satisfied. In this case, images are formed successively on the front sides of a set of papers accommodated in the two-sided imaging circulation path 9, and other images are formed successively on the back sides of the same set of papers. In this example, the scanning time for the even numbers of papers does not affect the paper interval and, therefore, the papers are fed at a constant interval. FIGS. 11(*c*) and 11(*d*) show the case in which the scanning time for the even numbers papers does affect the paper interval. In order to correctly feed the paper in this arrangement, the front-side papers are fed so that the paper interval satisfies equation Li (Letter Y)=((Ls/3)−Lp)×2+Lp (Letter Y), and the back-side papers are also fed at the same paper interval after circulation of the two-sided imaging path. Then, after the back-side imaging operation for this set of papers is finished, the first front-side paper of the next set of papers is fed onto the belt 5 at a paper interval Li (Letter Y)=((Ls/3)−Lp)×2. Then, the paper interval is reset to Li(Letter Y)=((Ls/3)−Lp)×2+Lp(Letter Y) for the subsequent front-side papers of this new set of papers.

<Operations of Main Body Controller 306>

Figure 12:
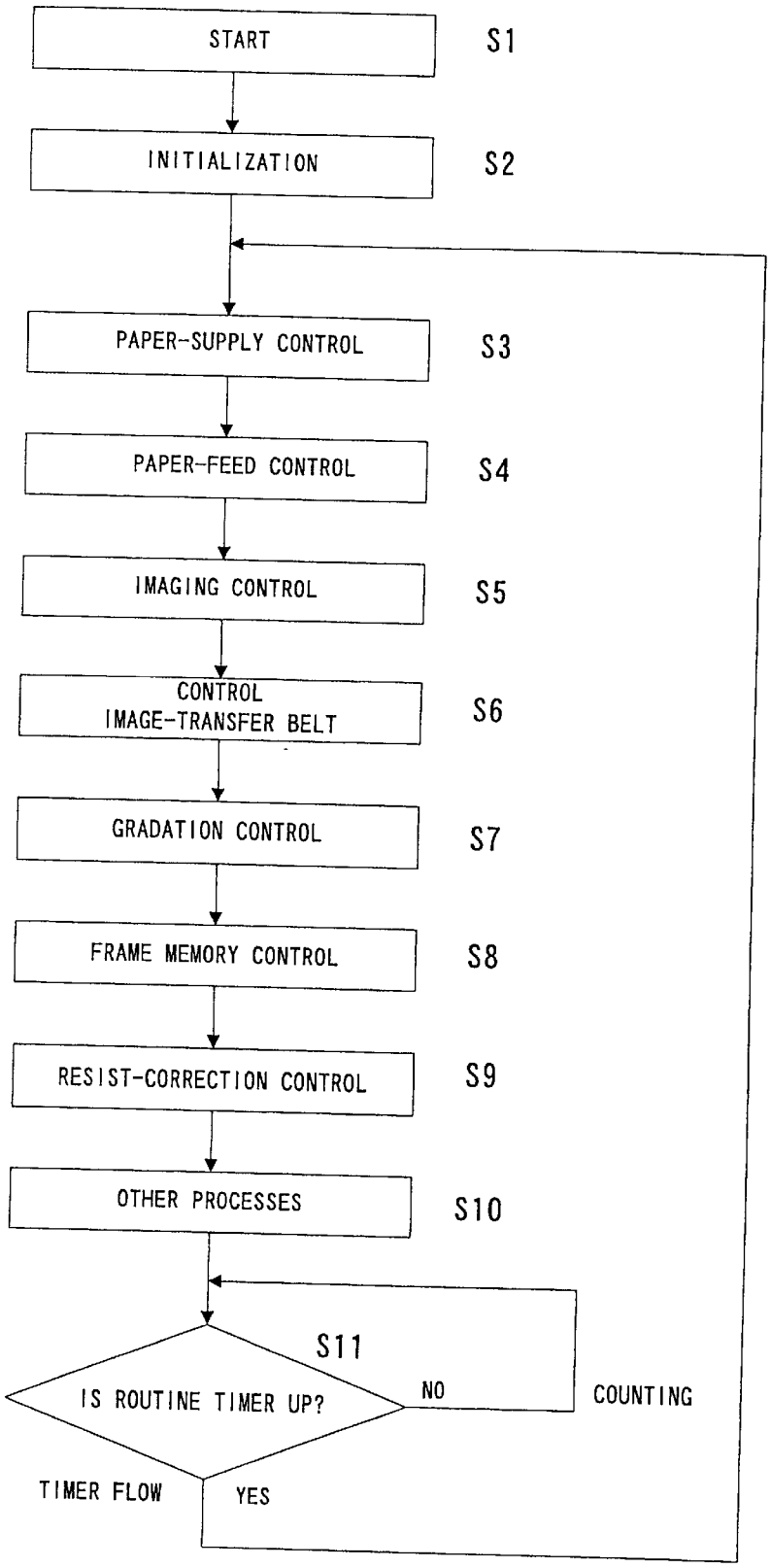
FIG. 12 is a flowchart showing a main routine process according to an embodiment of the present invention.

FIG. 12 is a flowchart showing the operation flow of the main body controller 306. When the power source is turned on to activate the CPU of the main body controller 306 (S1), prescribed initialization is performed for the CPU, the memory, I/O and other units (S2).

In S3, in response to a request for paper supply, papers stored in paper cassettes are supplied from the corresponding paper-supply ports 1*a*–1*d* to the paper-transportation path, the details of which will be described later.

In S4, the transported papers are fed onto the belt 5 to form and fix images on the paper, and the papers bearing images on their front faces are inverted and again fed to the belt 5. This step will be described in more detail later.

Then, the electronic imaging process is controlled in S5. Various sub-processes including charging, exposure, development, transfer, and discharging are controlled as necessary.

In S6, the motion of the belt 5 is controlled. At the same time, the position of the seam 5*a* is detected, and necessary information is generated. Some of the information relates to the prohibition and permission of paper supply, and the prohibition and permission of rotation of the timing rollers 8. The information may also include the paper sizes, the size of the original, and other imaging conditions.

In the subsequent three steps (that is, gradation control (S7), frame memory control (S8), and resist correction control (S9)), necessary commands and parameters are supplied to hardware 313, 314, and 315 which perform the associated operations.

Other processes are also performed in S10, including communication with other CPUs, detection of abnormal operations, input/output processes from the I/O port, and operations for external image formation devices which are not directly related with the present invention.

Finally, in S11, it is determined whether the routine timer is up. The routine timer is reset every time the operation flow from step 3 (paper supply) to step 10 (other processes) has been completed. If the routine timer is not up, the timer continuously counts.

<Paper-supply Control>

Figure 13:
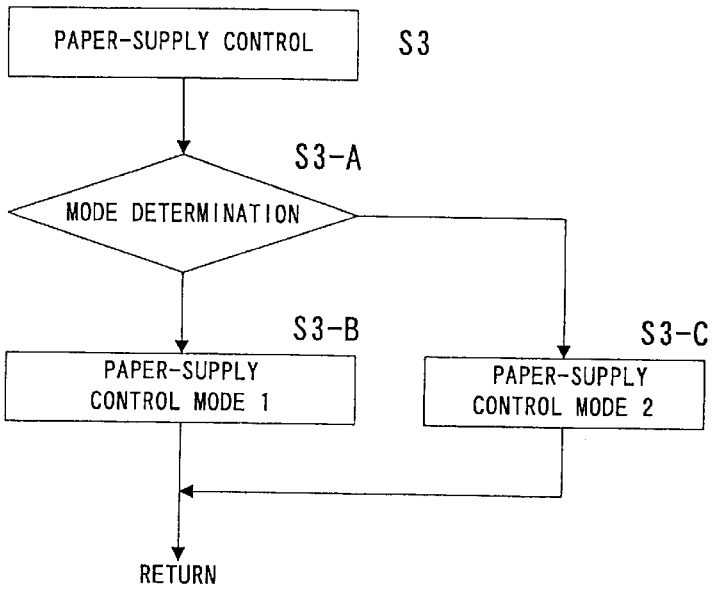
FIG. 13 is a flowchart showing a paper supply control in the main routine shown in FIG. 12.

FIG. 13 is a flowchart showing the sub-steps of the paper supply control (S3) shown in FIG. 12.

In the actual operation, several control operations are performed corresponding to the number of the paper-supply ports (1*a*–1*d* in this example).

There are two control modes (mode 1 and mode 2) in the paper supply control. The optimal mode is selected based on the imaging conditions in S3-A. If the control mode 1 is selected in S3-A, the process proceeds to S3-B, while if the control mode 2 is selected, S3-C is performed.

Figure 14:
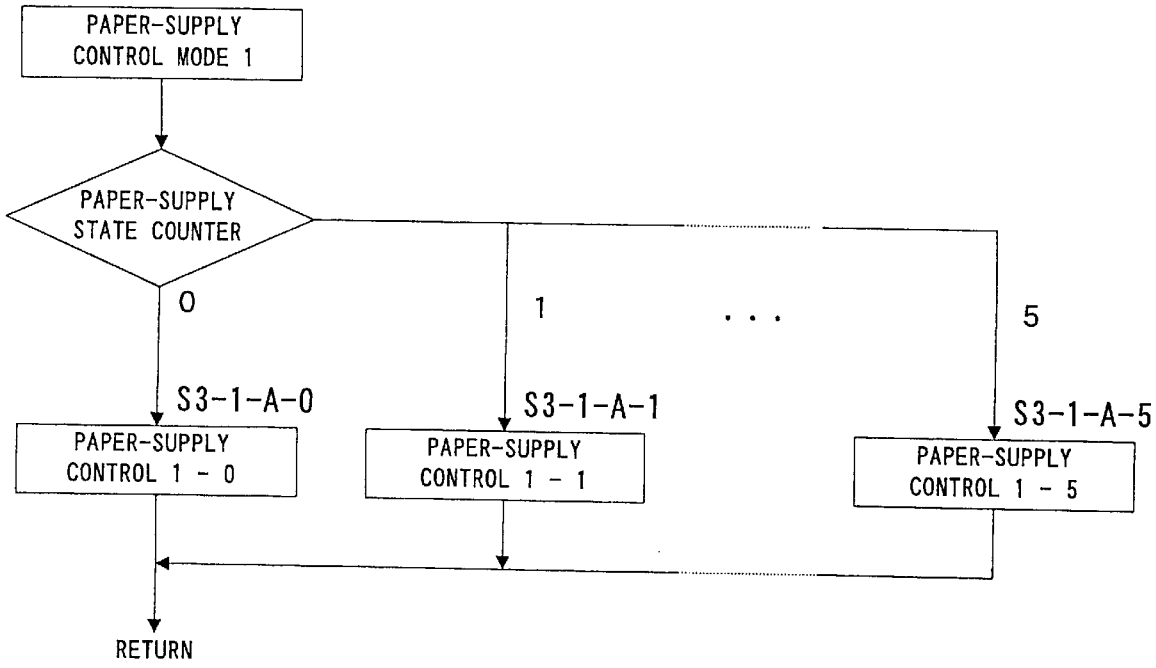
FIG. 14 is a flowchart showing a paper supply control 1 shown in FIG. 13.

The paper-supply control mode 1 is illustrated in FIGS. 14 through 20, where FIG. 14 shows the outline of this control mode, 190 and FIGS. 15 through 20 illustrate the detailed steps.

The paper supply control operation in mode 1 is further divided into six sub-controls, as shown in FIG. 14. In S3-1-A, the paper-supply state counter counts, and the process proceeds one of the six sub-control operations 1-0 to 1-5, which correspond to steps S3-1-A-0 through S3-1-A-5, according to the counter value. The state counter is initially set to 0, and incremented as the process of the paper control mode 1 advances.

Figure 15:
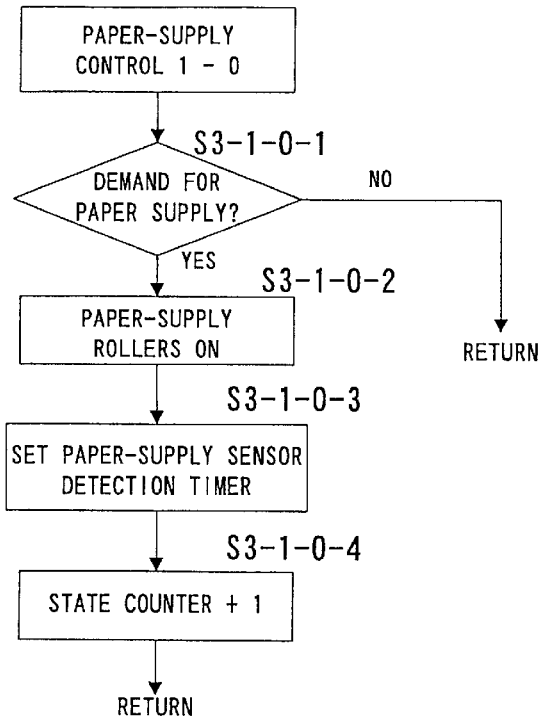
FIG. 15 is a flowchart showing a paper supply control 1-0 shown in FIG. 14.

FIG. 15 shows the operation flow of paper-supply control 1-0. First of all, it is determined if there is a request for paper supply (S3-1-0-1). If there is a request, the paper-supply rollers 11*a*–11*d* are turned on (S3-1-0-2). At this time, attribute information is created for the paper being requested (not shown in the flowchart). Attribute information includes the paper size and the paper-supply port.

Next, the paper-supply sensor detection timer is set (S3-1-0-3). The details of this timer will be described below. The state counter is incremented by 1 (S3-1-0-4), and the process returns to 3-1-A of FIG. 14.

Figure 16:
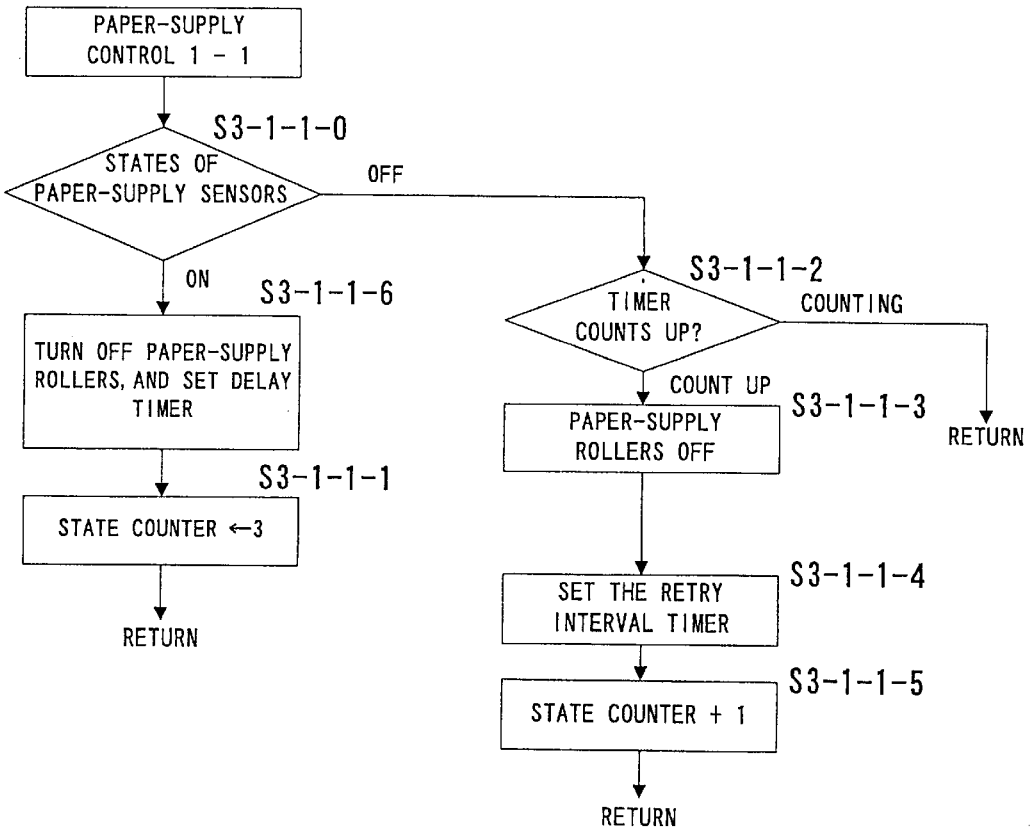
FIG. 16 is a flowchart showing a paper supply control 1-1 shown in FIG. 14.

If a predetermined period of time has passed, paper-supply control 1-1 shown in FIG. 16 is performed because the state counter has a value 1.

In FIG. 16, the states of the paper-supply sensors 12*a*–12*d* are confirmed in S3-1-1-0. If these sensors 12*a*–12*d* are in the ON state, the delay timer is set (S3-1-1-6). The delay timer counts time until the paper-supply rollers 11*a*–11*d* are turned off. Then, the state counter is incremented to the value 3 (S3-1-1-1), and the process terminates.

If the paper-supply sensors 12*a*–12*d* are in the OFF state, the process proceeds to the timer count processing operation (S3-1-1-2), in which the counter that was set in the paper-supply control operation 1-0 is decremented by 1. If the decrement result is not zero, the process terminates. If the decrement result is zero (0), then process proceeds to S3-1-1-3 in order to retry the paper supply operation.

In S3-1-1-3, the paper-supply rollers 11*a*–11*d* are turned off for a while. At this time, the attribute information created when the paper-supply rollers were turned is cleared (not shown in the flowchart).

The timer for counting the interval till the paper-supply rollers are again turned on is set in S3-1-1-4.

After the timer is set, the state counter is incremented by 1 (S3-1-1-5), and the process terminates.

Figure 17:
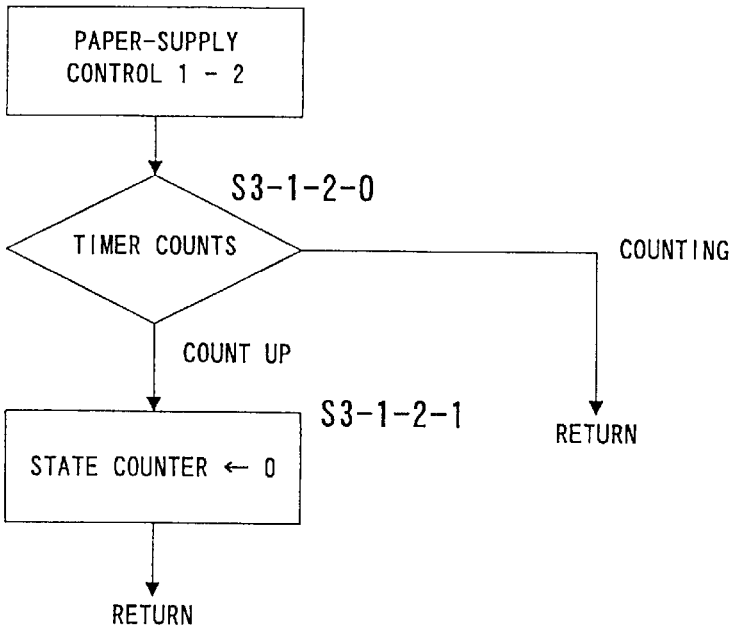
FIG. 17 is a flowchart showing a paper supply control 1-2 shown in FIG. 14.

FIG. 17 is a flowchart of paper-supply control 1-2. If the retry operation is selected in paper-supply control 1-1, the subsequent process is paper-supply control 1-2 shown in this flowchart. First, the timer counting state is checked (S3-1-2-0).

If the timer has not counted up yet, this step is repeated until the timer counts up.

If the timer counts up, the state counter is reset to zero (S3-1-2-1), and the process terminates. As a result, the paper-supply action is again started, which means that the retry operation was successfully performed.

Figure 18:
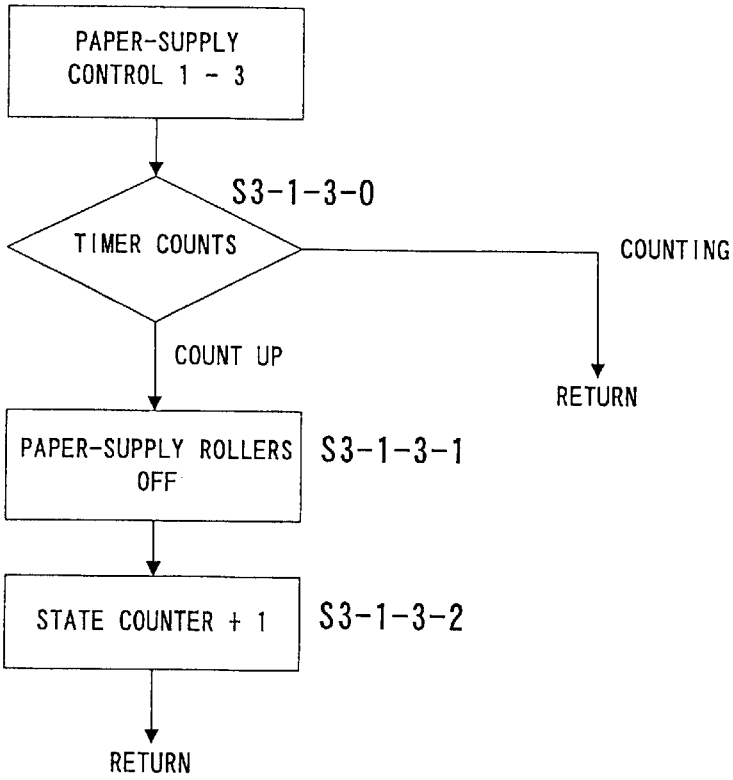
FIG. 18 is a flowchart showing a paper supply control 1-3 shown in FIG. 14.

If the retry control was not selected in paper-supply control 1-1, that is, if the state counter is incremented to 3, then paper-supply control 1-3 shown in FIG. 18 is performed.

In FIG. 18, the timer counting state is checked (S3-1-3-0), and if the timer has counted up to a predetermined amount, the paper-supply rollers 11*a*–11*d* are turned off (S3-1-3-1). The state counter is incremented by 1 (S31-3-2), and the process terminates.

Figure 19:
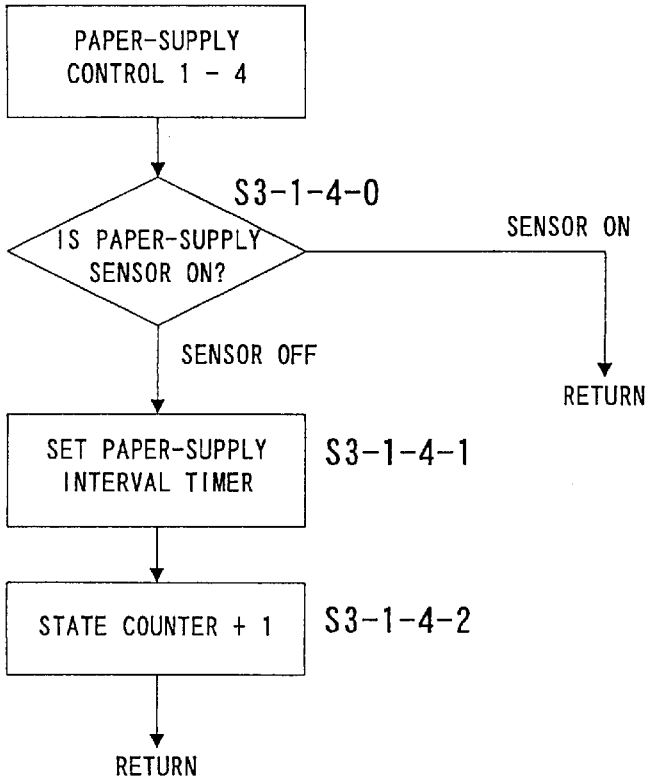
FIG. 19 is a flowchart showing a paper supply control 1-4 shown in FIG. 14.

FIG. 19 is a flowchart showing the operation flow of paper-supply control 1-4. First, it is determined if the current paper-supply sensor (one of the sensors 12*a*–12*d*) is in the ON state (S3-1-4-0). If the paper is passing by the sensor, the paper-supply sensor is in the ON state. If the trailing edge of the paper has passed by the sensor, the sensor becomes OFF.

When the paper has passed by the sensor and the sensor is turned off, the paper-supply interval timer is set (S3-1-4-1), the state counter is incremented by 1 (S3-1-4-2), and the process terminates.

Figure 20:
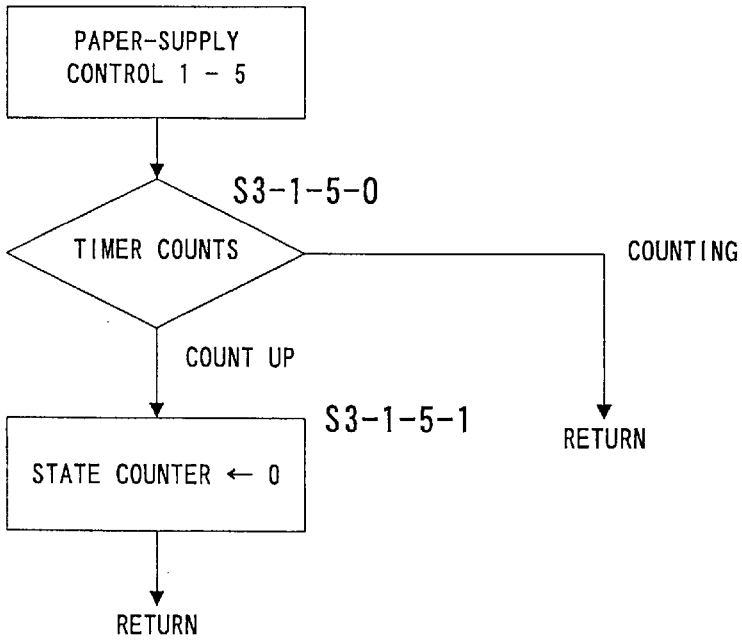
FIG. 20 is a flowchart showing a paper supply control 1-5 shown in FIG. 14.

FIG. 20 is a flowchart showing the operation flow of paper-supply control 1-5. First, the timer counting state is checked to (S3-1-5-0). If the timer has counted up, the state counter is further incremented and reset to zero (S3-1-5-1).

Although not shown in the flowchart, when the intermediate rollers (which will be explained below) positioned downstream of the paper-supply rollers 11*a*–11*d* are in the OFF state, the paper-supply rollers are temporarily turned off in order to avoid collision of papers. At this time, each timer counter is also interrupted.

The operations shown FIGS. 14 through 20 are repeated until the paper-supply request is reset. By controlling the paper supply operation in this manner, the distance from the trailing edge of the previous paper to the leading edge of the current paper can be kept constant. If this distance is set sufficiently smaller than the paper-supply interval of the timing rollers 8, paper feeding from the timing rollers 8 is not disturbed even if slipping or retry occurs in the paper-supply control operation. Thus, stable image formation is achieved.

Figure 21:
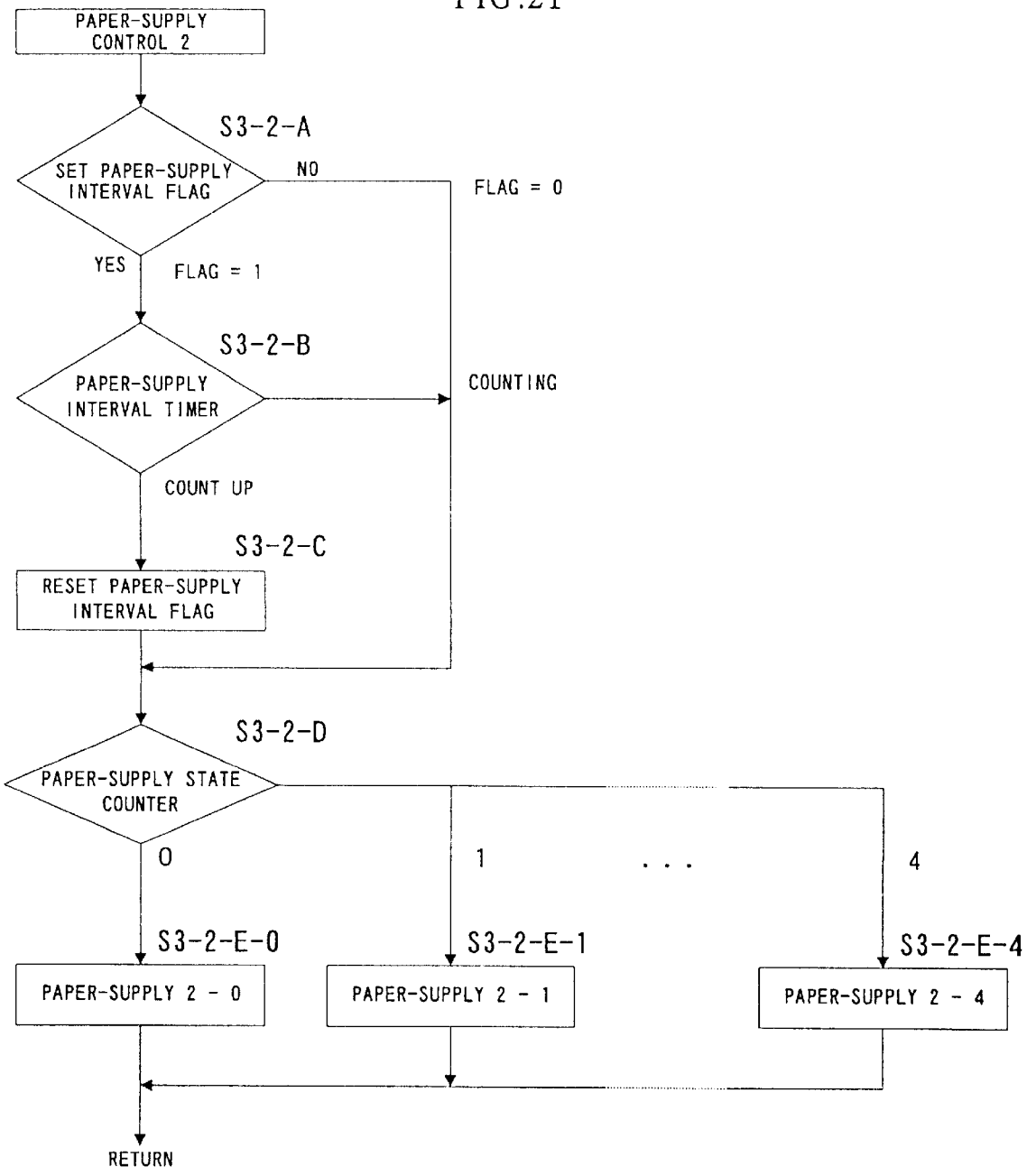
FIG. 21 is a flowchart showing a paper supply control 2 shown in FIG. 13.

FIG. 21 is a flowchart of the paper-supply control mode 2. Similar to the paper-supply control mode 1, the control 2 is also constituted by state control operations.

First, it is determined if the paper-supply interval flag is set (S3-2-A). If the flag is set (that is, if the flag has a value 1), the paper-supply interval timer is checked (S3-2-B). If the flag is not set (i.e., if the flag has a value 0), the process jumps to S3-2-D, in which the state counter counts prescribed values according to the progress of the process.

If the paper-supply interval timer is still counting in S3-2-B, the process also jumps to S3-2-D, where the state counter counts prescribed values. If the timer has counted up, then the paper-supply interval flag is reset (S3-2-C).

The determination process of the state counter (S3-2-D) is the same as in the paper-supply control mode 1 and, therefore, explanation for it will be omitted.

Figure 22:
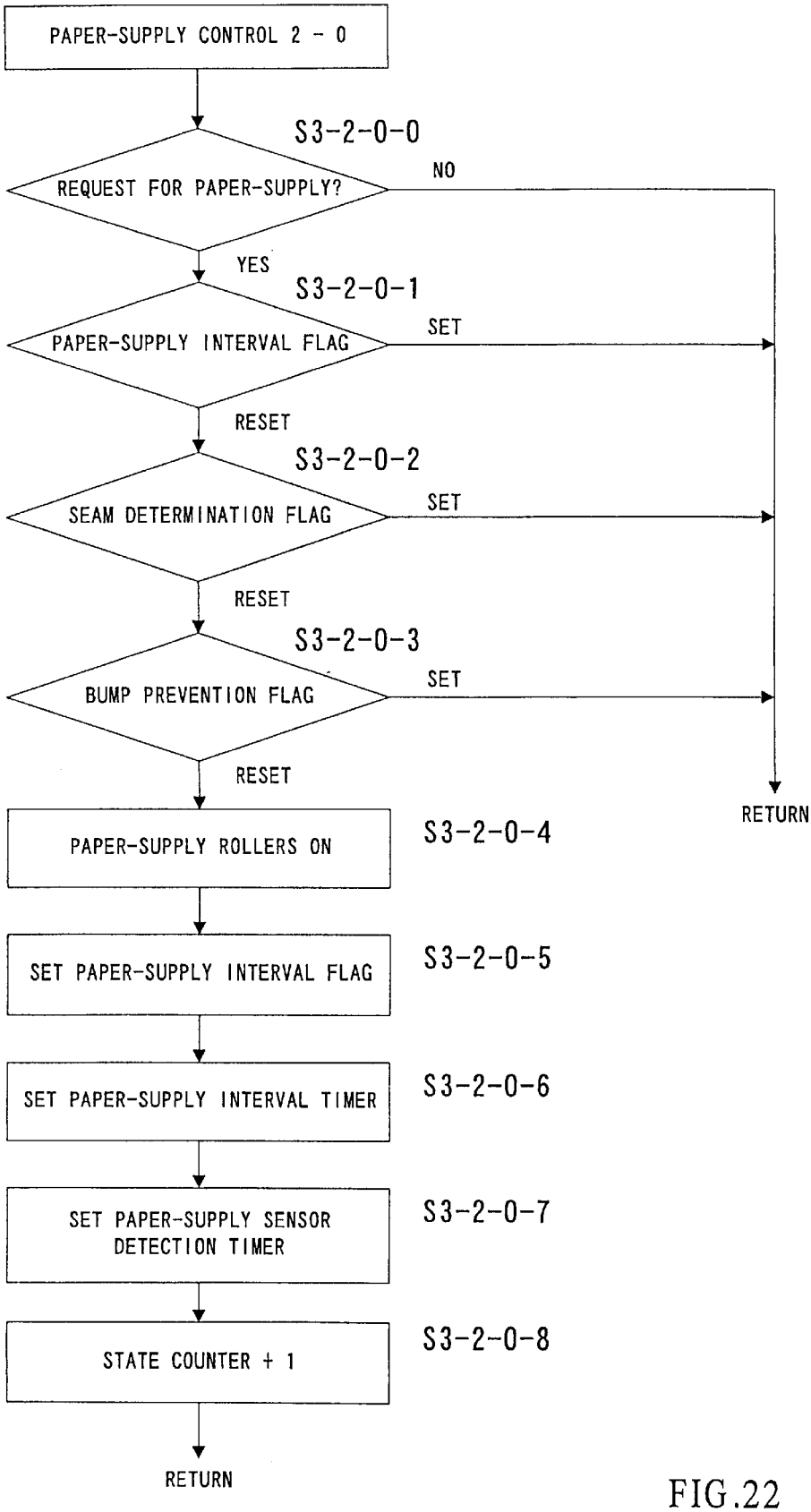
FIG. 22 is a flowchart showing a paper supply control 2-0 shown in FIG. 21.

If the state counter has a value 0, paper-supply control 2-0 is performed, as shown in FIG. 22. First, it is determined if there is a request for paper-supply request (S3-2-0-0). If there is a paper-supply request in S3-2-0-0, and if all of the paper-supply interval flag, the seam detection flag, and the bump prevention flag are reset in steps S3-2-0-1 through S3-2-0-3, then the paper-supply rollers 11*a*–11*d* are turned on (S3-2-0-4).

When the paper-supply rollers 11*a*–11*d* are turned on, attribute information of the paper supplied is created in the same manner as in the paper-supply control mode 1.

The paper-supply interval flag is used to determine the interval before the start of the next paper supply. If the paper-supply rollers 11*a*–11*d* are turned on, then the paper-supply interval flag is set (S3-2-0-5) . At the same time, the paper-supply interval timer is also set (S3-2-0-6). When the timer counts up, the paper-supply interval flag is cleared.

The seam determination flag is provided to each paper-supply port, and it comprises information about the position of the seam 5*a* of the belt 5, the distance from the associated paper-supply port to the timing roller 8, paper sizes, etc. If it is determined in S3-2-0-2 that a paper which is to be supplied to the belt will overlap the seam 5*a*, the seam determination flag is set.

If it is determined in S3-2-0-3 that a paper which is to be supplied may collide with the previous paper which is already in the paper feed path, the bump prevention flag is set. The bump prevention flag is also provided to each paper-supply port. In particular, this flag is used to prevent the paper which has passed through the image fixing unit and the circulation path 9 and returns to the timing rollers 8, from colliding with a paper newly supplied from a paper-supply tray.

The possibility of bump or collision is determined as follows.

As has been explained, a paper detection sensor is positioned downstream of the inversion unit 9*a* in the two-sided imaging circulation path 9. If the junction of the paper supply path from the paper-supply trays 1*a*–1*d* and the circulation path 9, along which the paper returns after the inversion at the inversion unit 9*a* the paper detection sensor 17, is G (shown in FIG. 1), the paper detection sensor 17 is placed at a position such that the distance from the detection sensor 17 to the junction G is longer than the distance from the paper-supply tray to the junction G.

When the paper which has passed through the inversion unit 9*a* is passing by the paper detection sensor 17, the point of time at which the paper reaches the junction G is calculated from the time the leading edge and the trailing edge of the paper pass through the sensor. The calculated time is updated each time. The time the leading edge and the trailing edge of a paper newly supplied from the tray reach the junction G are also calculated. If the calculated time duration, in which the paper from the inversion unit 9*a* occupies the junction G, overlaps the time duration, in which the paper supplied from one of the trays 1*a*–1*d* occupies the junction G, it is determined that a collision may occur. This determination is made to the papers from the inversion unit 9*a* before and after a new paper is supplied from one of the trays 1*a*–1*d*.

By controlling the paper feed operation so as to avoid a collision between a paper newly supplied from a tray and a paper circulated for back-side imaging, paper jam due to collision can be prevented even if the paper supply action is retried.

Returning to FIG. 22, the paper-supply sensor detection timer is set (S3-2-0-7), the state counter is incremented by 1 (S3-2-0-8), and the process for paper-supply control 2-0 terminates.

Figure 23:
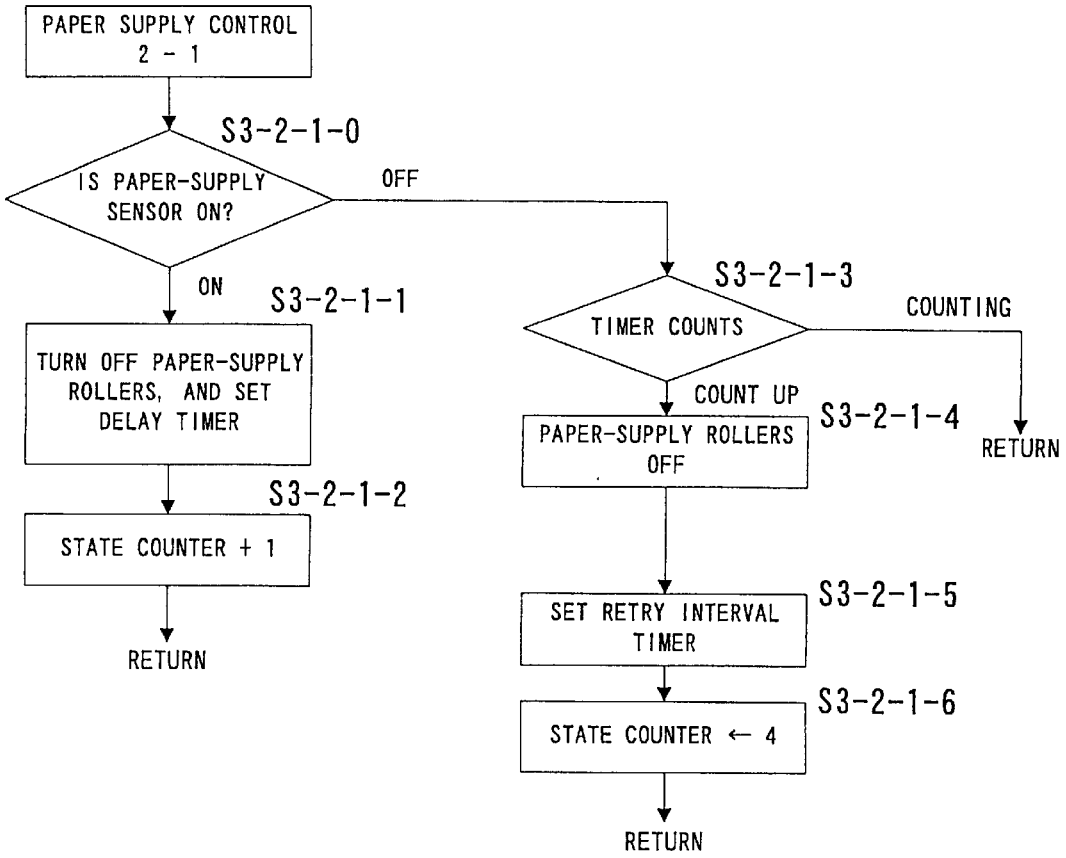
FIG. 23 is a flowchart showing a paper supply control 2-1 shown in FIG. 21.

FIG. 23 is a flowchart of paper-supply control 2-1. First, it is determined if the paper-supply sensor is in the ON state (S3-2-1-0). If the sensor is in the ON state, the paper-supply rollers are turned off, and the delay timer is set (S3-2-1-1). Then, the state counter is incremented by 1 (S3-2-1-2), and the process terminates.

If the paper-supply sensor is in the OFF state in S3-2-1-0, the timer counts (S-2-1-3). This timer was set when the paper-supply rollers were turned on, and the turn-on action of the paper-supply sensor is delayed until the timer counts up.

If the timer counts up before the paper-supply sensor is turned on, then the paper-supply rollers are temporarily turned off (S3-2-1-4). At this time, paper attribute information created when the paper-supply rollers were turned on is cleared (not shown in the flowchart).

Then, the retry interval timer is set (S3-2-1-5), the state counter is incremented to 4 (S3-2-1-6), and the process (i.e., paper-supply control 2-1) terminates.

Figure 24:
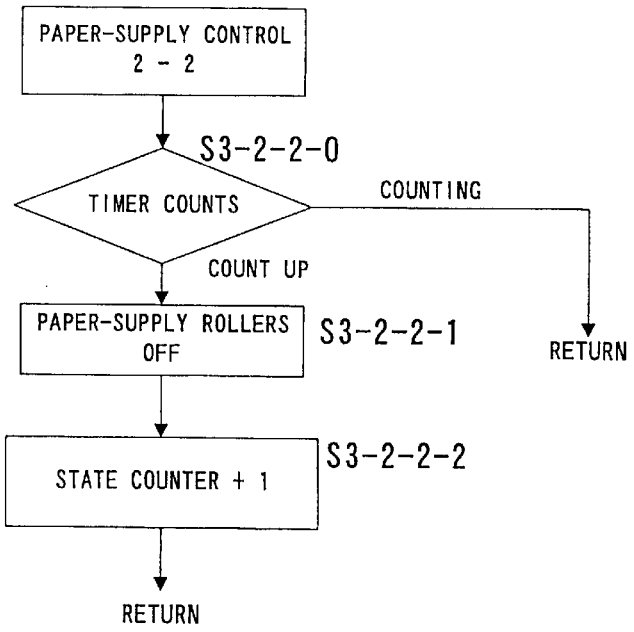
FIG. 24 is a flowchart showing a paper supply control 2-2 shown in FIG. 21.

FIG. 24 is a flowchart of paper-supply control 2-2. First, the counting state of the paper-supply roller OFF delay timer is checked (S3-2-2-0). If the timer has counted up, the paper-supply rollers are turned off (S3-2-2-1), and the state counter is incremented by 1 (S3-2-2-2).

Figure 25:
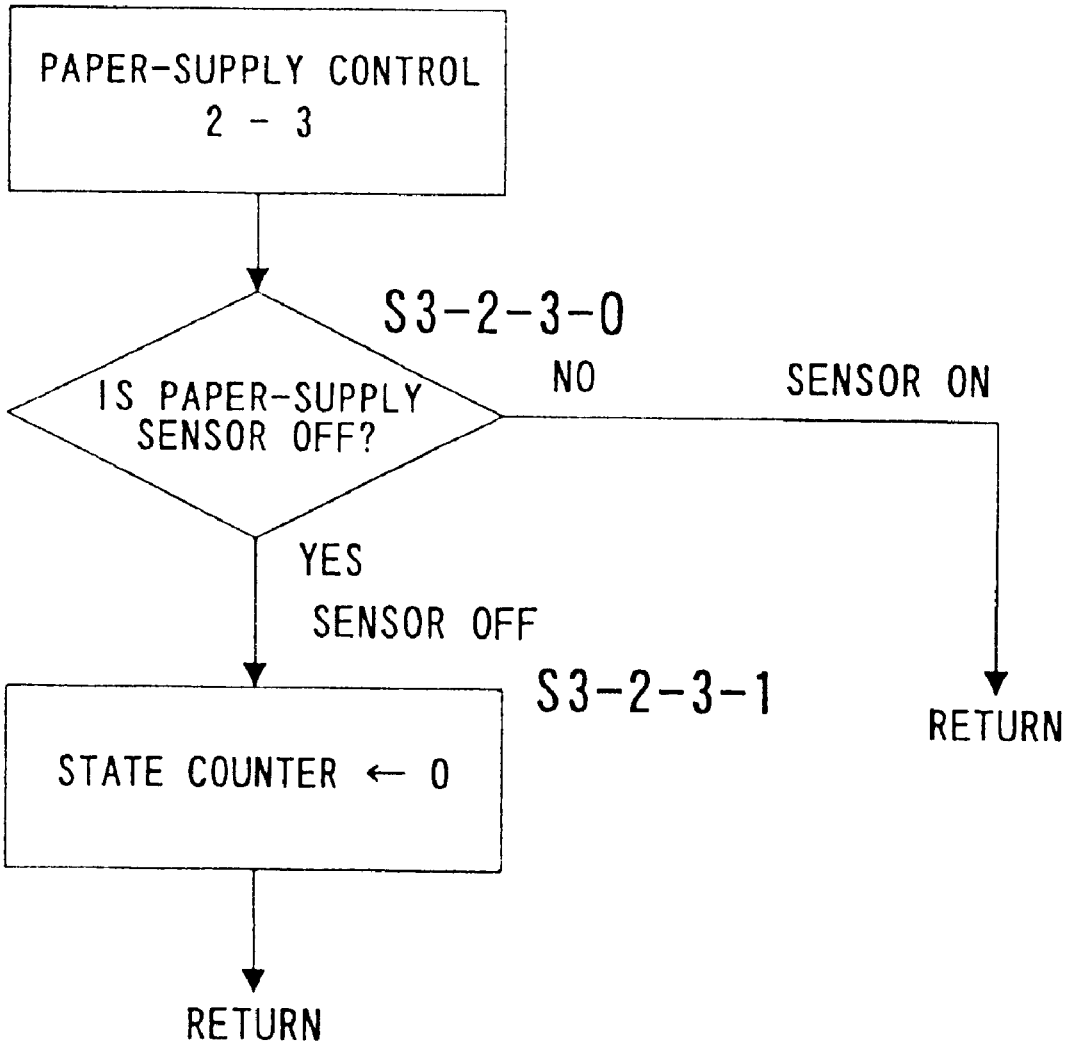
FIG. 25 is a flowchart showing a paper supply control 2-3 shown in FIG. 21.

FIG. 25 is a flowchart of paper-supply control 2-3. First, it is determined if the paper-supply sensor is in the OFF state (S3-2-3-0). If the sensor is in the OFF state, the state counter is reset to 0 (S3-2-3-1).

Figure 26:
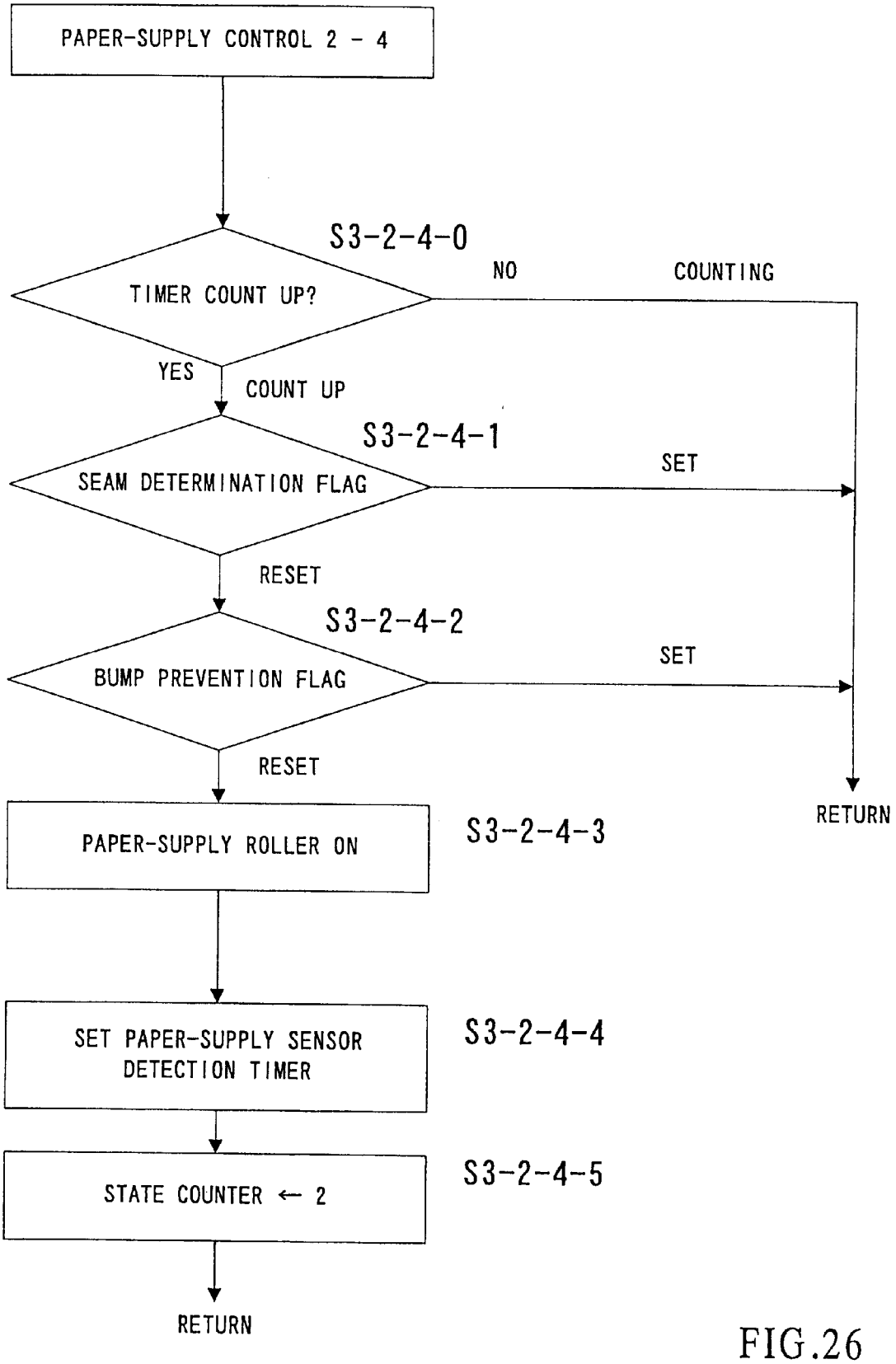
FIG. 26 is a flowchart showing a paper supply control 2-4 shown in FIG. 21.

FIG. 26 is a flowchart of paper-supply control 2-4. First, the counting state of the retry interval timer is checked (S3-2-4-0). If the timer has counted up, the states of the seam determination flag and the bump prevention flag are checked in S3-2-4-1 and S3-2-4-2. If both flags are not set (that is, the both flags are reset), the paper-supply rollers are turned on (S3-2-4-3). At this time, the paper attribute information is created (not shown in the flowchart).

Further, the paper-supply sensor detection timer is set (S3-2-4-4), and the state counter is incremented to 2 (S3-2-4-5), as in paper-supply control 2-0.

Thus, in the paper-supply control mode 2, paper is supplied from the cassette to the paper-transport path at a constant interval which is substantially the same as the paper-feed interval of the timing rollers 8. However, the paper may be supplied at a slightly shorter interval than the paper-feed interval of the timing rollers 8. In this case, even if slipping occurs in the paper-supply rollers 11*a*–11*d*, the slipping can be compensated for by the system. If a large slipping occurs, the paper-supply control is retried. Furthermore, the paper-supply interval may be slightly longer than the paper-feed interval in order to avoid the seam 5*a* or a collision with previously supplied paper.

Figure 27:
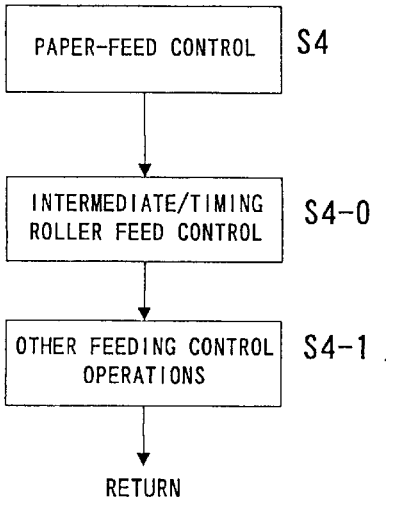
FIG. 27 is a flowchart showing a paper supply control in the main routine shown in FIG. 12.

FIG. 27 is a flowchart showing the details of step the paper-feed control operation S4 shown in FIG. 12.

In S4-0, the paper supplied from the cassette is temporarily paused at the controller for the intermediate roller/timing roller, and skew correction and timing are performed before the paper is fed onto the belt 5.

Then, other paper-feed control operations are performed in S4-1, and the process terminates.

Figure 28:
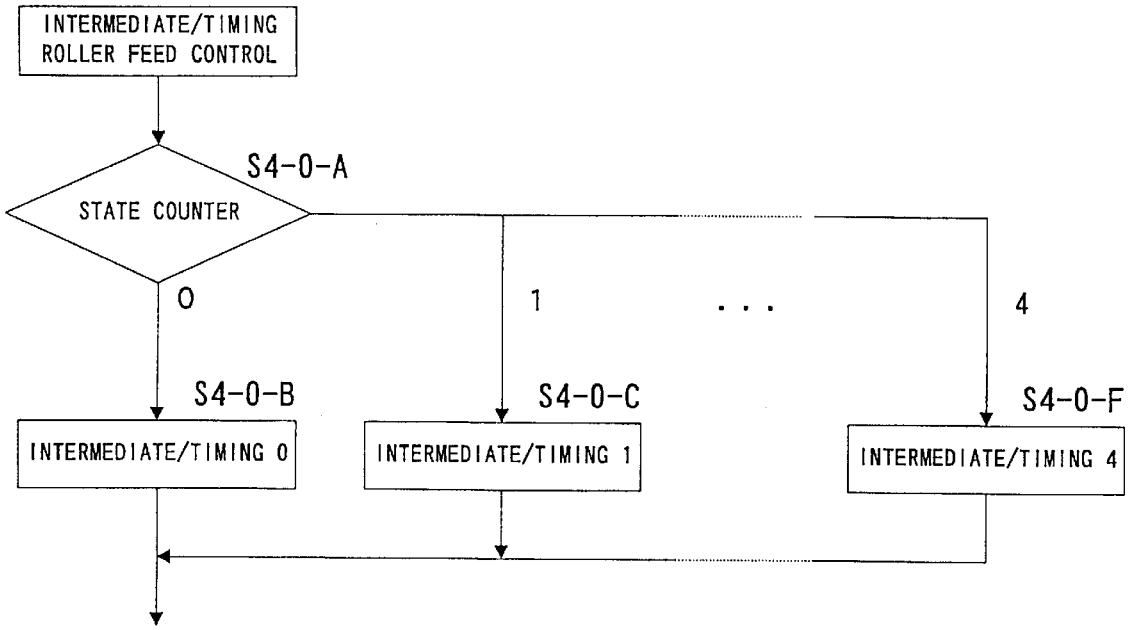
FIG. 28 is a flowchart showing an intermediate/timing roller feed control shown in FIG. 27.

FIG. 28 is a flowchart showing the detailed steps of S4-0 shown in FIG. 27. This operation is constituted by state control, and five sub-control operations 0 through 4 are performed according to the values of the state counter.

Figure 29:
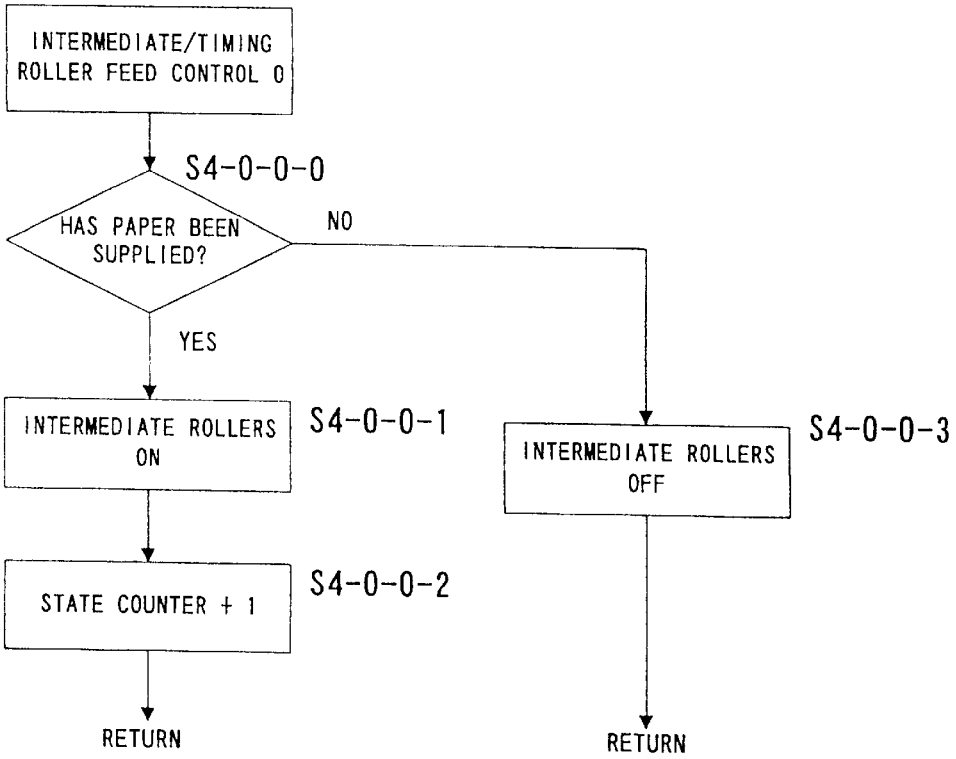
FIG. 29 is a flowchart showing an intermediate/timing roller feed control 0 shown in FIG. 28.

FIG. 29 is a flowchart of intermediate/timing roller feed control 0 shown in FIG. 28.

First, it is determined if paper has been supplied to the paper-transport path from the cassette (S4-0-0-0). If YES in S4-0-0-0, the intermediate rollers are turned on (S4-0-0-1). If paper has not been supplied yet (i.e., if NO in S4-0-0-0), the intermediate rollers are kept in the OFF state (S4-0-0-3). If the intermediate rollers are turned on, the state counter is incremented by 1 (S4-0-0-2).

Figure 30:
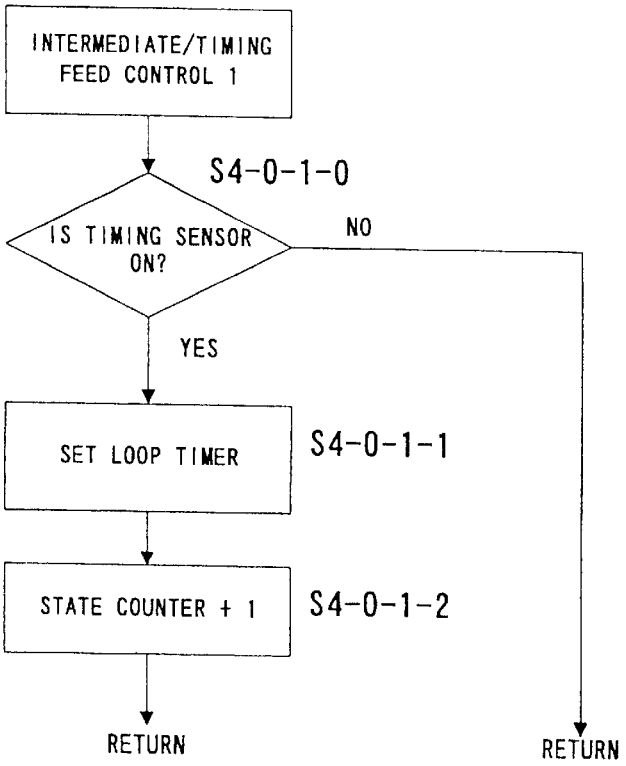
FIG. 30 is a flowchart showing an intermediate/timing roller feed control 1 shown in FIG. 28.

FIG. 30 is a flowchart of intermediate/timing roller feed control 1 shown in FIG. 28.

As a paper is supplied from the cassette, it is determined if the timing sensor 13 is in the ON state (S4-0-1-0). The timing sensor 13 is turned on when the leading edge of the supplied paper comes into contact with the timing rollers 8. If the timing sensor 13 is turned on in S4-0-1-0, the loop timer is set (S4-0-1-1). In other words, the loop timer starts counting from the point of time at which the paper comes into contact with the timing rollers 8. The timer is up when a prescribed loop for skew correction is formed.

Then, the state counter is incremented by 1 (S4-0-1-2).

Figure 31:
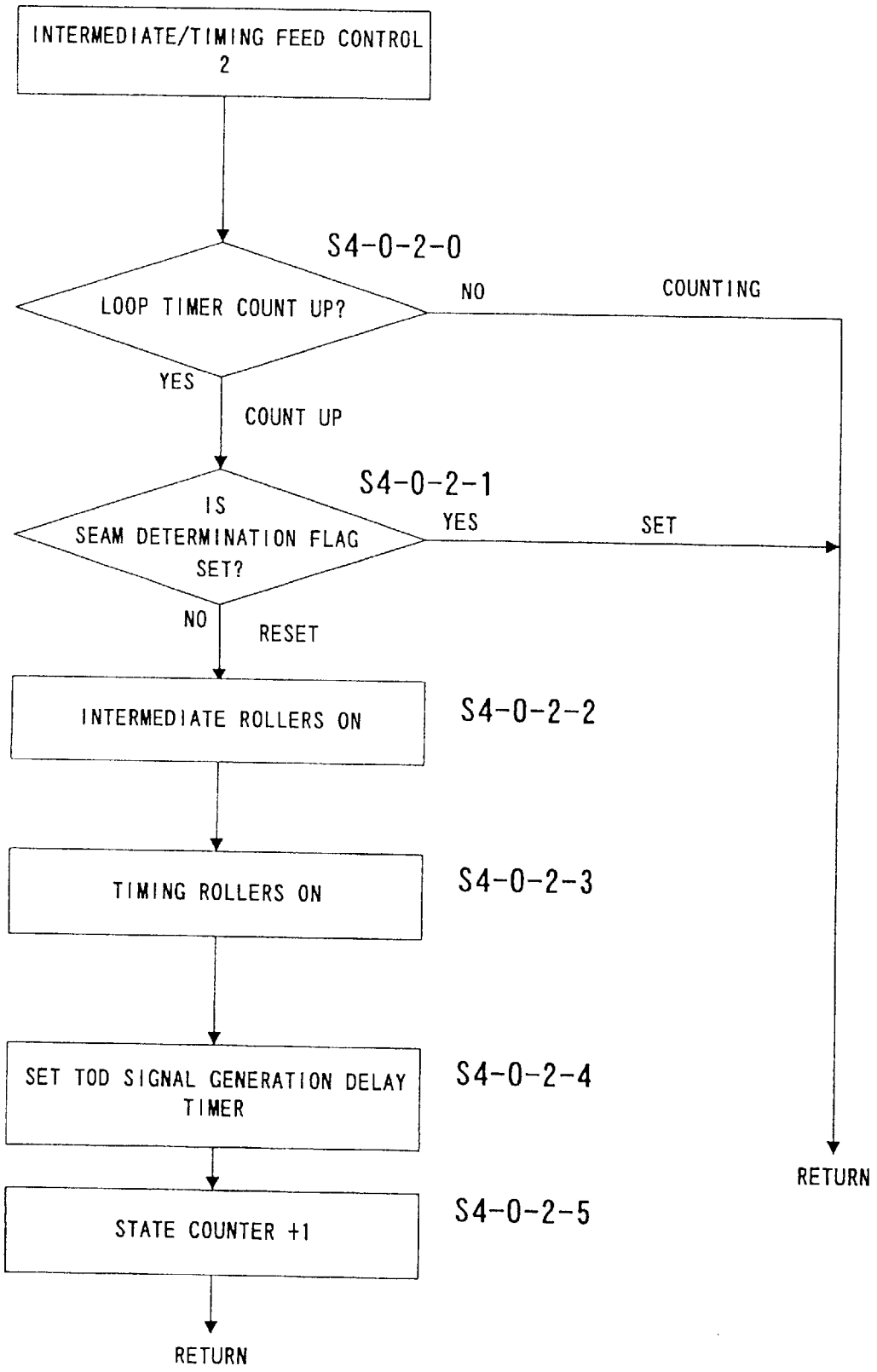
FIG. 31 is a flowchart showing an intermediate/timing roller feed control 2 shown in FIG. 28.

FIG. 31 is a flowchart of intermediate/timing roller feed control 2 shown in FIG. 28.

First, it is determined if the loop timer set in feed control 1 shown in FIG. 30 has counted up (S4-0-2-0). If the loop timer is up in S4-0-2-0, and if the seam determination flag is not set (i.e., the flag is reset) in S4-0-2-1, then the intermediate rollers are turned on (S4-0-2-2), and the timing rollers are also turned on (S4-0-2-3). The TOD signal generation delay timer is set in S4-0-2-4. TOD signal is an image request signal. When a predetermined time has passed since the TOD signal is generated, the image is written on the photosensitive drum.

Then, the state counter is incremented by 1 (S4-0-2-5), and the process terminates.

The TOD timer, which was set in S4-0-2-4, counts in other processes (not shown), and a TOD signal is generated when the timer is up. In addition, when a paper is fed by the timing rollers 8, the paper attribute information created when the paper was supplied from the cassette is also transmitted to each element. When an image is formed on one side of a paper, and when the paper is circulated back to the timing rollers 8 through the circulation path 9, the information that the paper already bears an image on one side is added to the paper attribute information. Accordingly, this attribute information can be used for controlling the paper side for two-sided imaging process.

Figure 32:
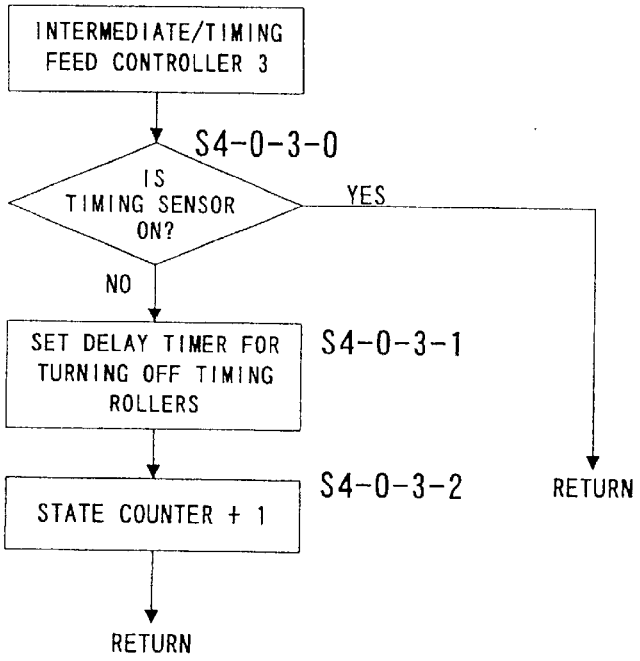
FIG. 32 is a flowchart showing an intermediate/timing roller feed control 3 shown in FIG. 28.

FIG. 32 is a flowchart of intermediate/timing roller feed control 3 shown in FIG. 28. It is determined if the timing sensor 13 is in the ON state in S4-0-3-0. The timing sensor is kept in the ON state while the paper passes by the sensor 13. When the trailing edge of the paper has passed by the sensor 13, the timing sensor 13 is turned off. If it is determined in S4-0-3-0 that the timing sensor 13 is turned off, the delay timer for turning off the timing rollers 8 is set in S4-0-3-1. The timer value is a sum of the time required for the trailing edge of the paper to move from the timing sensor 13 to the timing rollers 8 and a margin. After the timer is set, the state counter is incremented by 1 (S4-0-3-2), and the process terminates.

Figure 33:
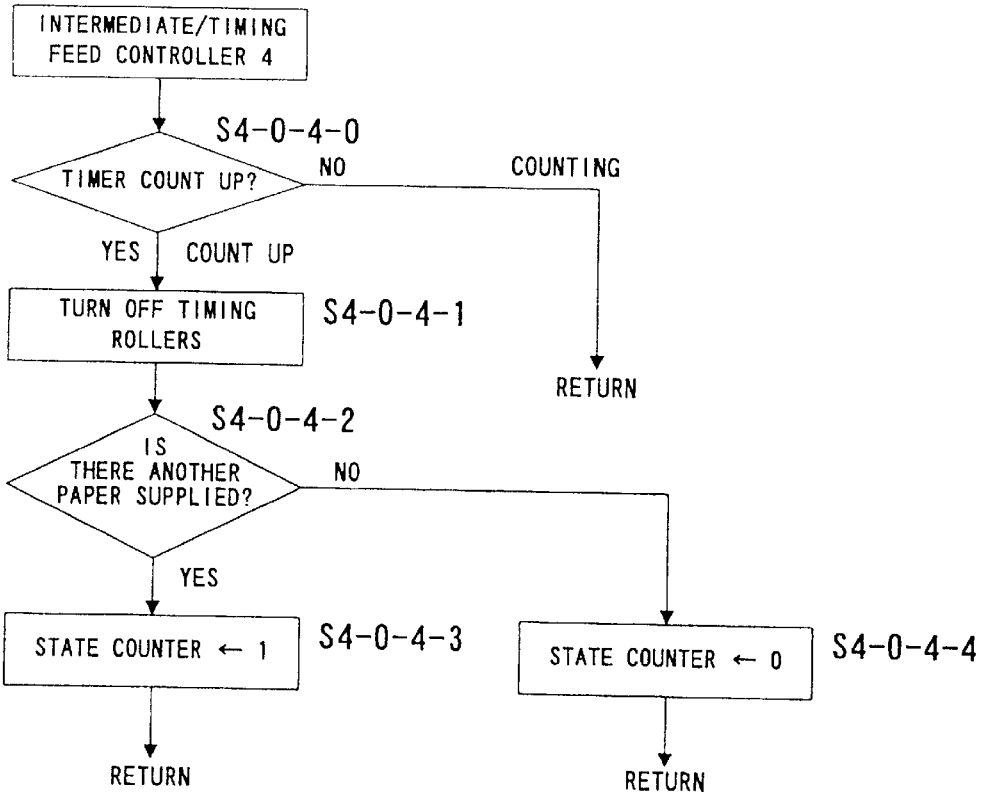
FIG. 33 is a flowchart showing an intermediate/timing roller feed control 4 shown in FIG. 28.

FIG. 33 is a flowchart of intermediate/timing roller feed control 4 shown in FIG. 28. It is determined if the delay timer set in the feed control 3 has counted up (S4-0-4-0) If the timer has counted up, the timing rollers 8 are tuned off (S4-0-4-1) Then, it is determined if there is a paper that was supplied from the cassette, but has not been fed to the image-transfer belt 5 (S4-0-4-2). If there is a paper, the state counter is updated to 1 (S4-0-4-3), and the process waits until that paper reaches the timing sensor 13. If there is no paper left in the path from the cassette to the timing rollers 8, the state counter is reset to zero (0) (S4-0-4-4), and the intermediate rollers are stopped.

<Paper Inversion Unit>

Figure 34:
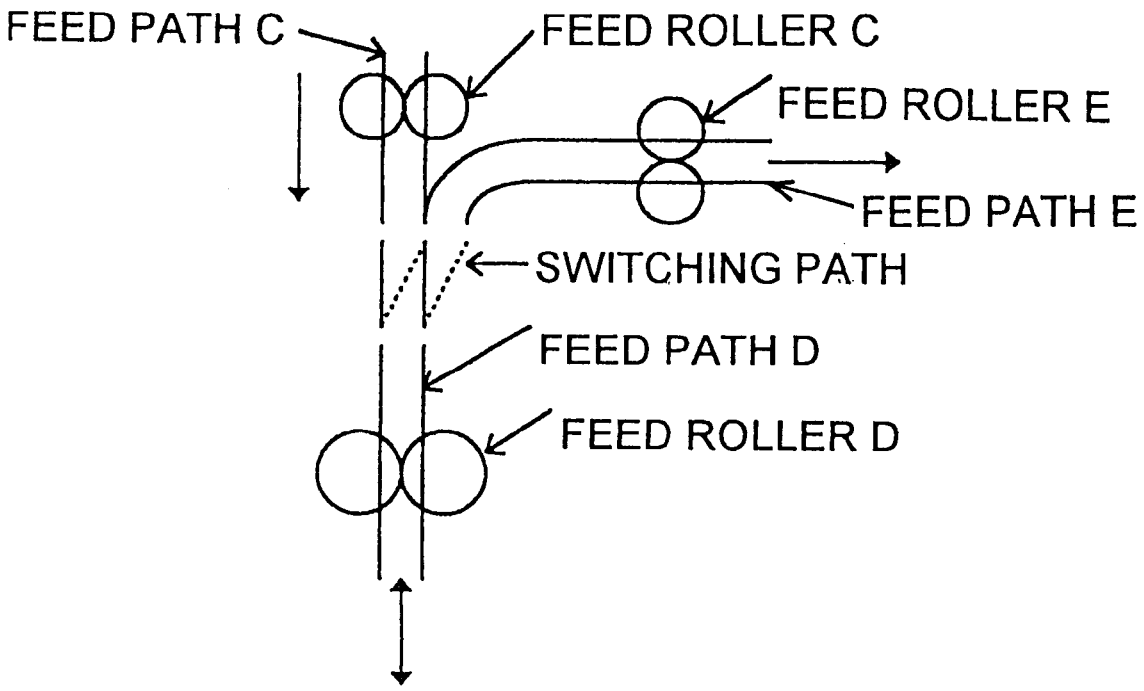
FIG. 34 is a schematic view of a paper inverting unit.

FIG. 34 illustrates the structure of the paper inversion unit 9*a*.

During the two-sided imaging process, after an image is formed and fixed on one side of a paper by the photosensitive drums and the image fixing rollers, the paper must be inverted and returned to the timing roller for another image formation on the back side. The paper which has passed through the fixing rollers with an image on one side is fed from the top of FIG. 34 by the feed rollers C through the paper feed path C.

At this time, the switching path is connected to the feed path C, as indicated by the solid lines. Accordingly, the paper is further transported to the bottom of FIG. 34 by the feed rollers D. A paper sensor (not shown) is provided between the feed rollers C and D.

After a predetermined time has passed after the trailing edge of the paper passed by the paper sensor, the feed rollers D are temporarily turned off, and the switching path is connected to the feed path E, as indicated by the dashed lines.

Then, the feed rollers D are rotated again in the opposite direction in order to return the paper toward the switching path. This time, the paper is transported to the feed path R by the feed rollers E, and guided to the image-transfer belt 5.

The predetermined time after the trailing edge passes by the sensor to the temporary pause of the feed rollers D can be adjusted depending on the situation.

For example, if a retry operation was performed during the paper supply step, the predetermined time can be slightly shortened, whereby the delay caused by the retry operation can be recovered. Other delays due to, for example, a roller slip can also be recovered by setting an inversion timer slightly shorter. On the other hand, if the paper reaches the switching path earlier due to the variations in the roller speed, the predetermined time may be increased in order to keep a constant paper interval.

<Detection of Paper Size>

The sizes of the papers stored in the paper-supply trays 1*a*–1*d* are manually input through the operation panel. The size-input liquid crystal display 212 (FIG. 2) is opened by pressing certain keys on the operation panel in a prescribed order, for example, by pressing the stop key 203 twice and, successively, pressing the tray selection key 208 twice. When the input display is opened, a desired paper-supply tray is selected by the tray selection key, and the dimensions (i.e., the vertical and horizontal lengths) are input through the ten keys 201. The input is fixed by pressing the print key 202. Exit from the input display is achieved by simply pressing the reset key on the ten keys.

<Control for Image-transfer Belt>

Figure 35:
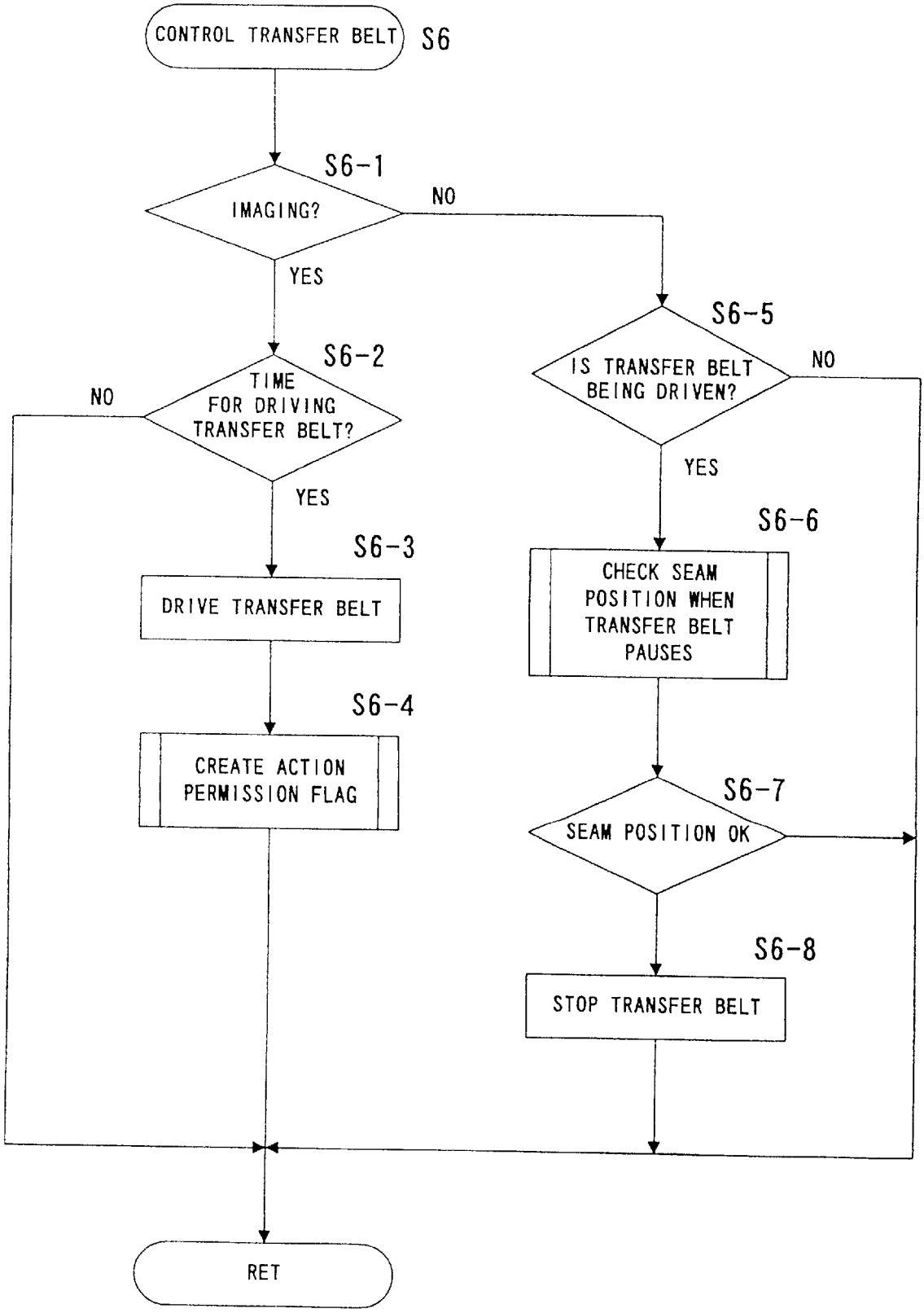
FIG. 35 is a flowchart showing a belt control in a main routine shown in FIG. 12.

FIG. 35 is a flowchart showing the control operations S6 for the image-transfer belt shown in FIG. 12.

First, it is determined if an image is being formed on the current paper in S6-1. If the paper is under the photocopying operation (i.e, YES in the determination of S6-1), it is further determined in S6-2 if it is time for driving the belt 5. The correct timing for driving the belt 5 results in the leading edge of the first paper being placed immediately after the seam 5*a* on the belt 5. If the belt driving time is confirmed in S6-2, the belt 5 is driven in S6-3. The second and subsequent papers are treated based on the assumption that the belt driving timing is determined correctly in S6-2.

Then, an action permission flag is created in S6-4. The action permission flag includes a paper-supply permission flag for allowing a paper to be supplied from the tray, and a re-feed permission flag for allowing the paper temporarily paused before the timing rollers 8 to be transported again. Permission or non-permission of the action is determined based on the assumption whether or not the paper would overlap the seam 5*a* if such an action were to be taken at that moment. If it is predicted that the seam 5*a* will be covered with the paper, that action is not allowed. The details of this process will be described later.

If the paper is not under the photocopying process (i.e., NO in the determination of S6-1), the process proceeds to S6-5, in which it is determined if the belt 5 is being driven. If the belt 5 is being driven in S6-5, in spite of the determination of not photocopying in S6-1, the belt is stopped so that the seam 5*a* stops at a predetermined position in order to allow the next image to be formed on the next paper in minimum time (S6-6 through S6-8).

Figure 36:
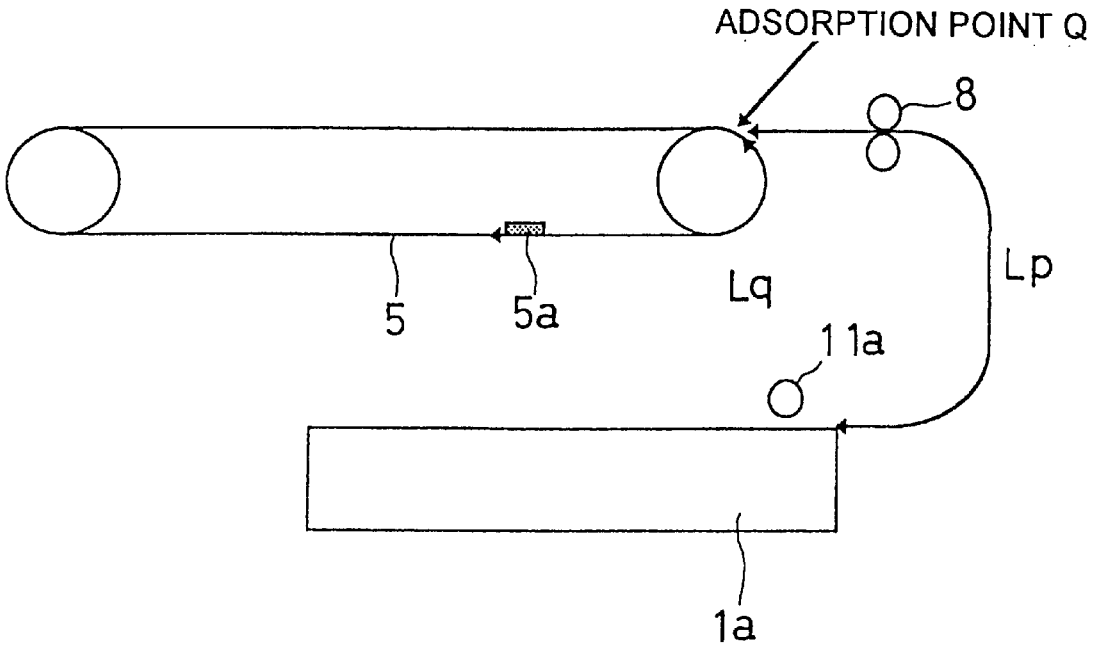
FIG. 36 is a schematic view of a paper supplying unit and a belt according to an embodiment of the present invention.

To be more precise, an adherence point Q, at which the leading edge of the paper being transported becomes adhered to the belt, is provided to the belt 5, as shown in FIG. 36. If the distance from point Q to the leading edge of the paper stored in the cassette is Lp, and if the distance from point Q to the seam 5*a* is Lq, then the belt 5 is stopped so that the relation Lp>Lq is satisfied. One this relation is established, the leading edge of the next paper can be correctly positioned directly after the seam 5*a* without a pause at the timing rollers 8, by delaying the start of driving the belt 5 for a time corresponding to the difference between Lp and Lq. Thus, the next paper does not have to wait for the seam 5*a* having passed by. The value of Lp is determined from the position of the first cassette so that the paper supplied from any other cassette can satisfy Lp>Lq.

<Creation of Action Permission Flag (S6-4 in FIG. 35)>

In step S6-4, a paper-supply permission flag and a re-feed permission flag are set or reset.

The paper-supply permission flag is set only if it is determined that the current paper will not overlap the seam 5, assuming that this paper is supplied from the cassette at this point of time.

The re-feed permission flag is set only if it is determined that the paper which is currently paused at the timing rollers 8 will not overlap the seam 5*a* of the belt 5, assuming that this paper is transported again at this point of time.

Figure 37:
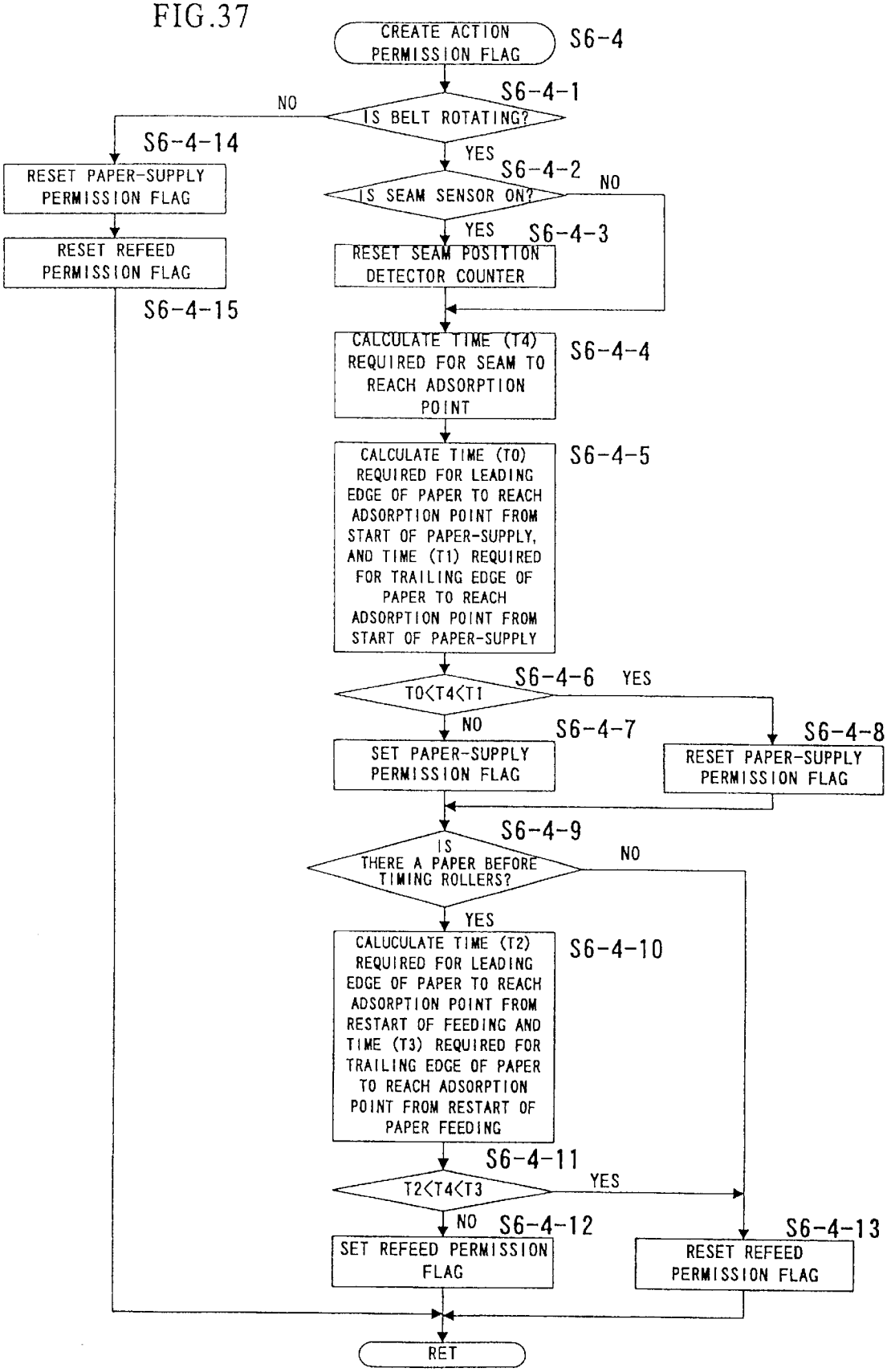
FIG. 37 is a flowchart showing an operation permit flag process shown in FIG. 36.

FIG. 37 is a flowchart showing this flag creation. First, it is determined if the image-transfer belt 5 is rotating in S6-4-1. If the belt 5 is stationary (NO in the determination of S6-4-1), no paper can be supplied or re-transported and, therefore, a paper-supply permission flag is reset (S6-4-14).

If the belt 5 is rotating (YES in S6-4-1), it is determined if the seam sensor 10 is in the ON state in S6-4-2. If the seam sensor 10 is ON (YES in S6-4-2), the seam position detection counter is reset (S6-4-3). This counter is counting during the rotation of the belt 5, and the distance from the seam sensor 10 to the seam 5*a* can be known based on the counter value. In addition, based on this value of the seam-position detection counter, time T4 required for the seam 5*a* to reach the adherence point Q is calculated in S6-4-4. The calculated value of T4 varies depending on the revolution rate of the image-transfer belt 5. If the seam sensor is OFF (NO in S6-4-2), the process jumps to S6-4-4.

Next, in S6-4-5, times T0 and T1 required for the leading edge and the trailing edge of a paper to reach the adherence point Q are calculated, based on the assumption that this paper is supplied from the cassette at this point of time. T0 and T1 also vary depending of the paper-feed speed and the size of the selected paper.

If T0, T1, and T4 satisfy the relation $$T0<T4<T1$$

in S6-4-6, the paper to be supplied will overlap the seam 5*a* and, accordingly, the paper-supply permission flag is reset (S6-4-8). If T0<T4<T1 is not satisfied (i.e., if NO in the determination of S6-4-6), the paper-supply permission flag is set (S6-4-7).

Then, it is determined if there is a paper directly before the timing rollers 8 (S6-4-9). If there is a paper (i.e., YES in S6-4-9), set/reset operations for a re-feed permission flag are performed in S6-4-10 through S6-4-13.

In S6-4-10, times T2 and T3 required for the leading edge and the trailing edge of the paper positioned directly before the timing rollers 8 to reach the adsorption point Q are calculated, based on the assumption this paper is transported again by the timing rollers 8. T2 and T3 vary depending on the paper-feed speed and the size of the paper.

If T2, T3, and T4 satisfy the relation $$T2<T4<T3$$

in S6-4-11, the paper, which is to be transported again, will overlap the seam 5*a* and, accordingly, the re-feed permission flag is reset (S6-4-13). If T2<T4<T3 is not satisfied (i.e., If NO in the determination of S6-4-11), the re-feed permission flag is set (S6-4-12). If there is no paper before the timing rollers 8 (i.e., NO in S6-4-9), the re-feed permission flag is set in S6-4-13.

<Paper-supply Port Designation Control>

Figure 38:
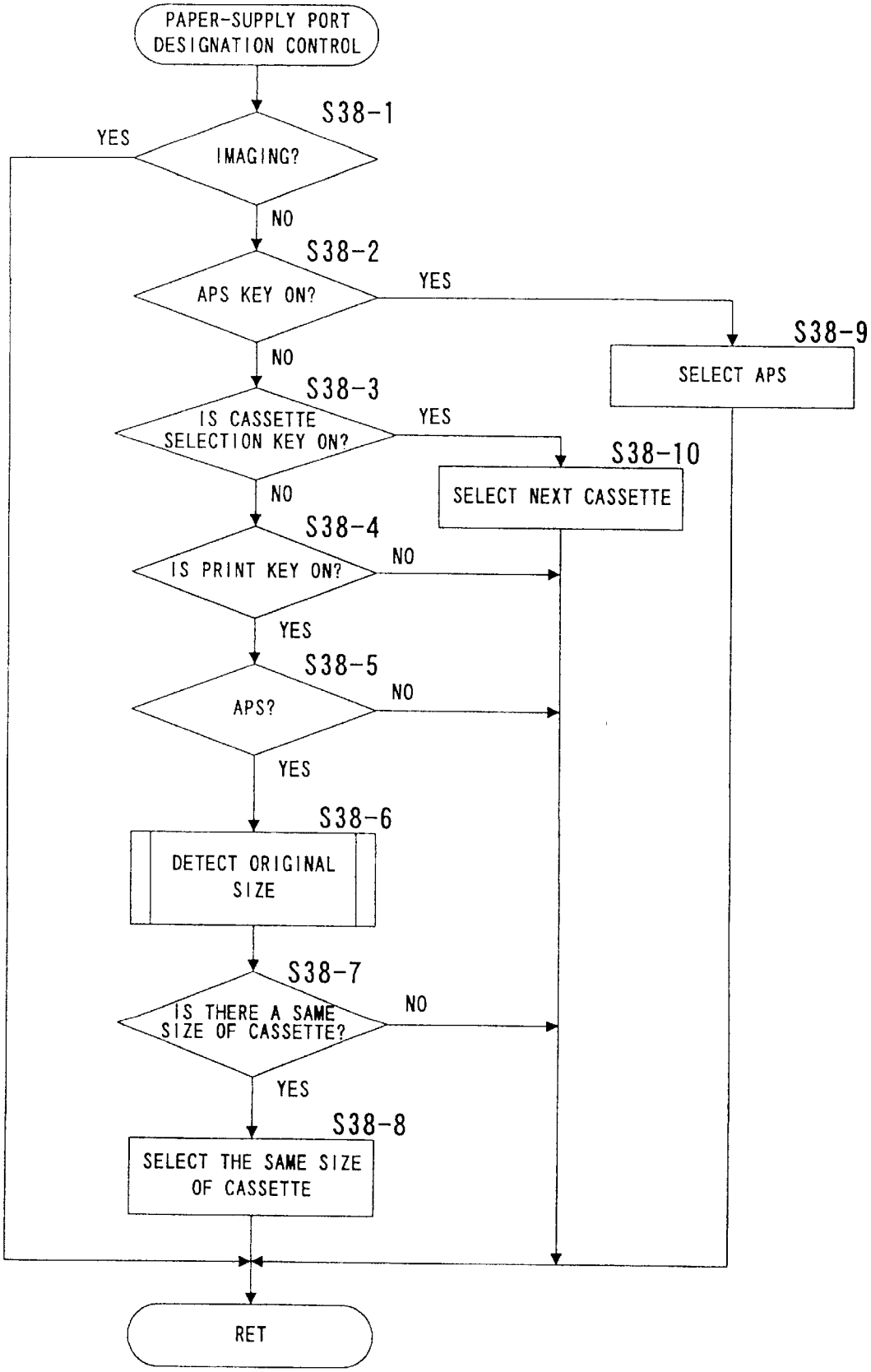
FIG. 38 is a flowchart showing a paper supply control process according to an embodiment of the present invention.

FIG. 38 is a flowchart showing the paper-supply designation control operations.

The paper-supply ports 1*a*–1*d* can not be switched during an imaging process. Therefore, it is determined if an image is being formed (or photocopied) in S38-1. If no image is being formed (i.e., NO in S38-1), it is determined if the APS (auto-paper selection) key 208 has been pressed in S38-2. If the APS key has been pressed, the process jumps to S38-9, in which the APS mode is set. If the APS key has not been pressed (i.e., NO in S38-2), then it is determined in S38-3 if the cassette selection key has been pressed.

If the cassette selection key has been pressed (i.e., YES in S38-3), the cassette directly below the currently selected cassette is selected (S38-10). If the lowermost cassette is currently selected, the first (i.e., the uppermost) cassette is selected in S38-10. If the APS mode is currently selected, the APS mode is released first and, then, the first cassette is selected.

If the cassette selection key has not been pressed, it is determined if the print key 202 has been pressed (S38-4). If YES in the determination of S38-4, the auto-cassette selecting operations are performed in S38-5 through S38-8.

In S38-5, it is determined if the APS mode is selected. If YES in S38-5, the size of the original is detected (S38-6). Then, it is determined if there is a cassette storing the same size of papers as the original (S38-7). If YES in S38-7, that cassette is selected in S38-8.

<Selection of One-sided Mode and Two-sided Mode>

Figure 39:
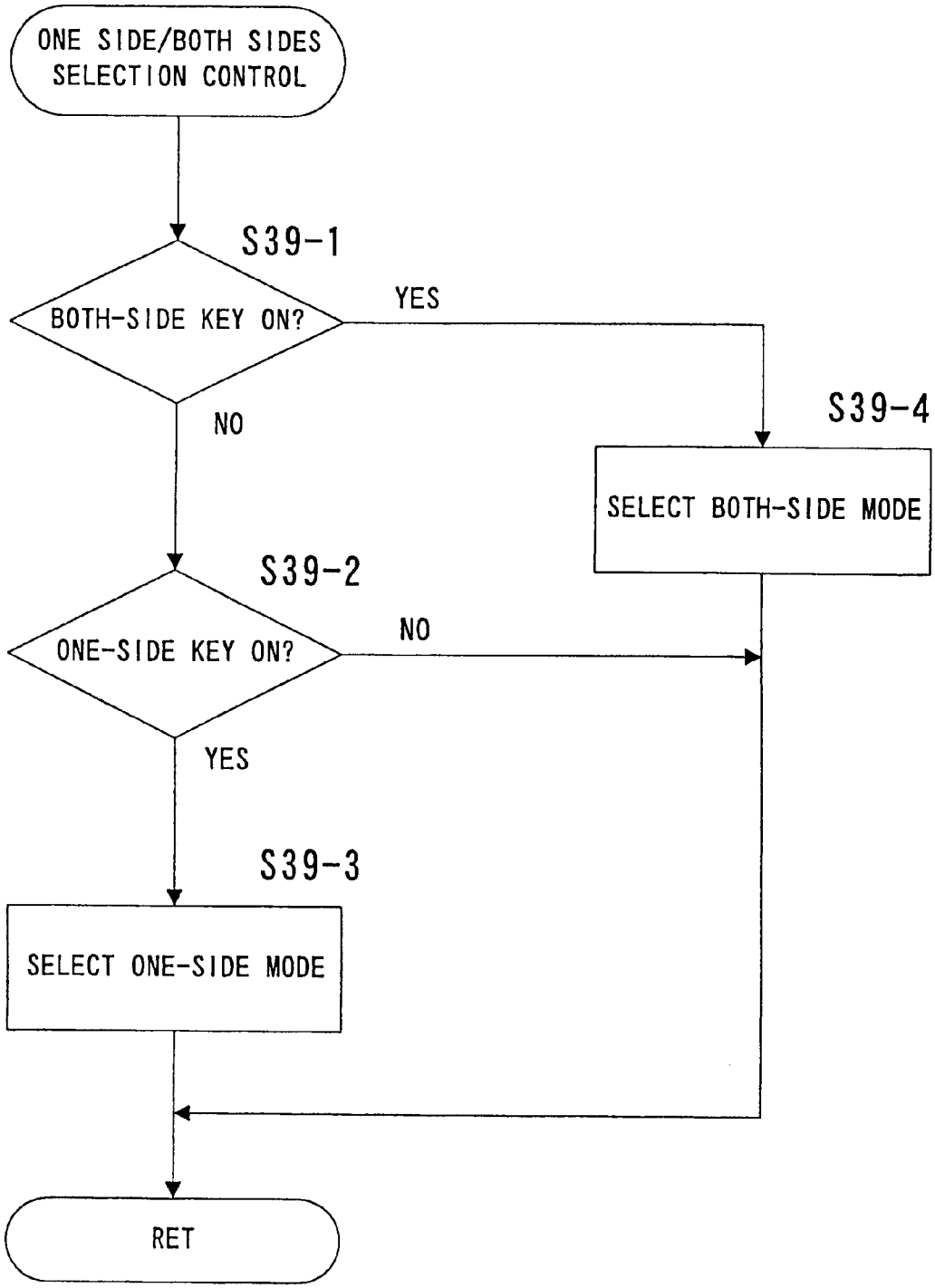
FIG. 39 is a flowchart showing a control for selecting one sided or two sided image forming according to an embodiment of the present invention.

FIG. 39 is a flowchart showing the operations for selecting the one-sided mode or the two-sided mode.

First, it is determined if the two-sided key has been pressed in S39-1. If the two-sided key has been pressed (YES in S39-1), the process jumps to S39-4, in which the two-sided mode is selected. If the two-sided key has not been pressed (NO in S39-1), it is determined if the one-sided key has been pressed (S39-2). If the one-sided key has been pressed (YES in S39-2), the one-sided mode is selected in S39-3.

<Detection of the Original Size>

Figure 40:
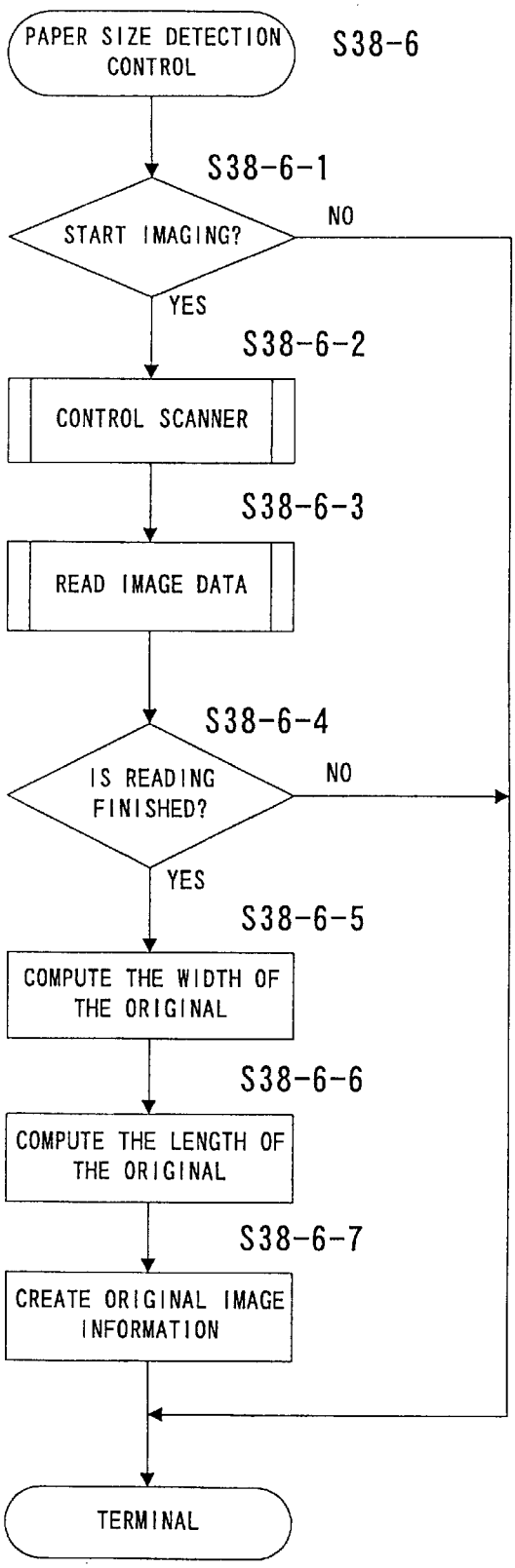
FIG. 40 is a flowchart showing a paper size detecting process in connection with the process shown in FIG. 38.

FIG. 40 is a flowchart showing the detailed steps of the detection of the original size (S38-6) shown in FIG. 38.

First, it is determined if there is a request for imaging (or photocopying) in S38-6-1. If there is a request (YES in S38-6-1), the scanner is activated in order to read the original image data (S38-6-2). During the scan, the image data is captured by the CCDs, and stored in the memory.

If it is determined in S38-6-4 that all the image data has been read, the length and the width of the original are calculated based on the accumulated image data in S38-6-5 and S38-6-6.

Then, the original image information is created in S38-6-7. The details of this step will be described below.

Figures 41, 42:
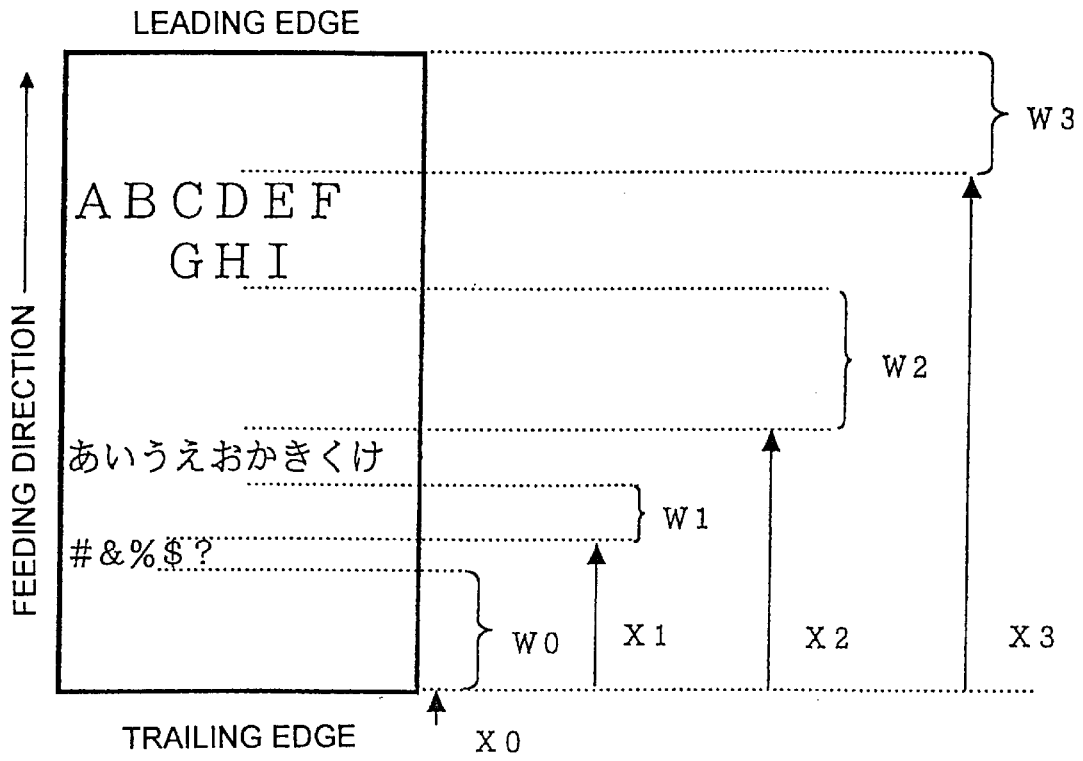
FIG. 41 is a view showing an example of image data according to an embodiment of the present invention.
FIG. 42 is a view showing document image information according to an embodiment of the present invention.

The original image information is used to control the positional arrangement of the image area and the blank area in the resultant copy for each original. FIG. 41 shows an example of a photocopy. W0–W3 are blank areas, and the other portions are image areas. X0, X1, X2, and X3 are the distances from the trailing edge of the paper to the trailing edges of the respective blank areas. If there is no image near the trailing edge of the paper, X0 becomes 0. FIG. 42 illustrates the original image information created for the example shown in FIG. 41.

Since the number of areas containing image data differs among the originals, the image data information contains Xi and Wi writing areas, where i=0. . . n. The left column in FIG. 42 indicates whether or not each area contains image data (i.e., whether or not that area can be referred to). If a certain area contains image data, that area is indicated as "valid."

Figure 43:
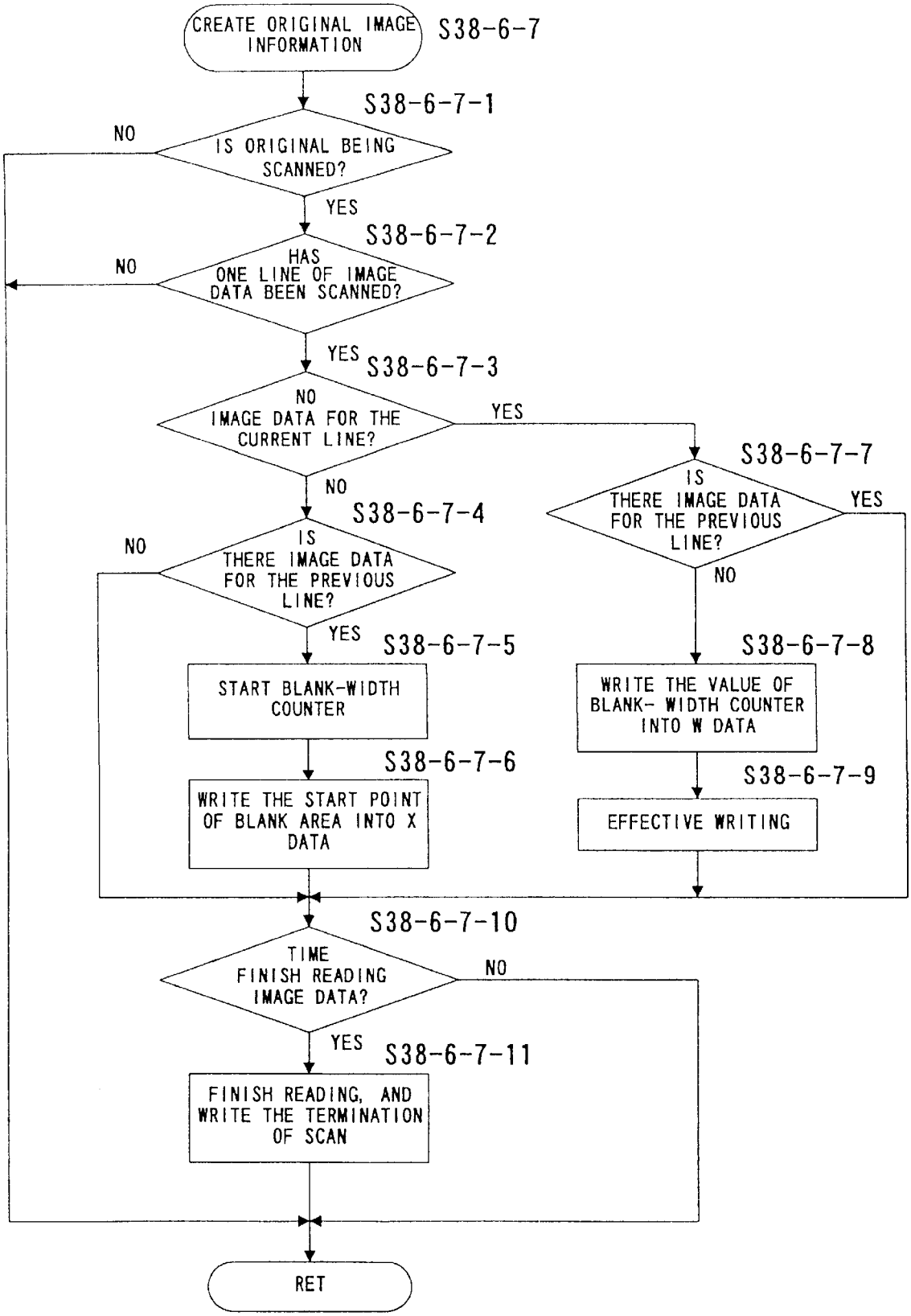
FIG. 43 is a flowchart showing processing of document image information shown in FIG. 40.

FIG. 43 is a flowchart showing the detailed steps of the creation of the original image information (S38-6-7) shown in FIG. 40.

It is determined whether the original is being read (or scanned) in S38-6-7-1. If the original is under the scan (YES in S38-6-7-1), the original image information is going to be created.

In S38-6-7-2, it is determined if one line of image data has been scanned. If YES in S38-6-7-2, it is determined if there is no image data in this current line in S38-6-7-3. In either case (either YES or NO), it is further determined if there is image data in the previous line (S38-6-7-4 if YES, and S38-6-7-7 if NO in the determination of S38-6-7-3). If there is no image in the current line (NO in S38-6-7-3), and if there is image data in the previous line (YES in S38-6-7-4), then it is regarded that the current line is a starting point for a blank area. Therefore, the blank-width counter is started at this time in order to measure the width of the blank area (S38-6-7-5). The start point of the blank area is written as X data shown in FIG. 42. In this example, the X data has the minimum value of i, and the writing area for this X data is designated as "invalid." Then, the process proceeds to S38-6-7-10.

If, on the other hand, the current line has image data (YES in S38-6-7-3), and if the previous line has no image data (NO in S38-6-7-7), it is regarded that the current line is a starting point for an image area. In this case, the value of the blank-width counter is converted into millimeter (mm), and written in as W data shown in FIG. 42. The writing area for this W data is designated as "valid" in S38-6-7-9. The i value for this W data is also minimum, similar to the X data of the above example. The process proceeds to S38-6-7-10.

In S38-6-7-10, it is determined if it is time to finish reading the image data. If YES in S38-6-7-10, the termination of the scan is written in S38-6-7-11. If it is determined that it is not time to finish scanning (NO in S38-6-7-10), the process returns.

<Imaging Side Designation Control>

In the two-sided imaging mode, whether the image is formed on the front face or the back face must be correctly controlled. Since two pages of image data scanned by the image reader (IR) are stored together, the image data for the front face and the image data for the back face of a copy paper must be correctly read out.

Figure 44:
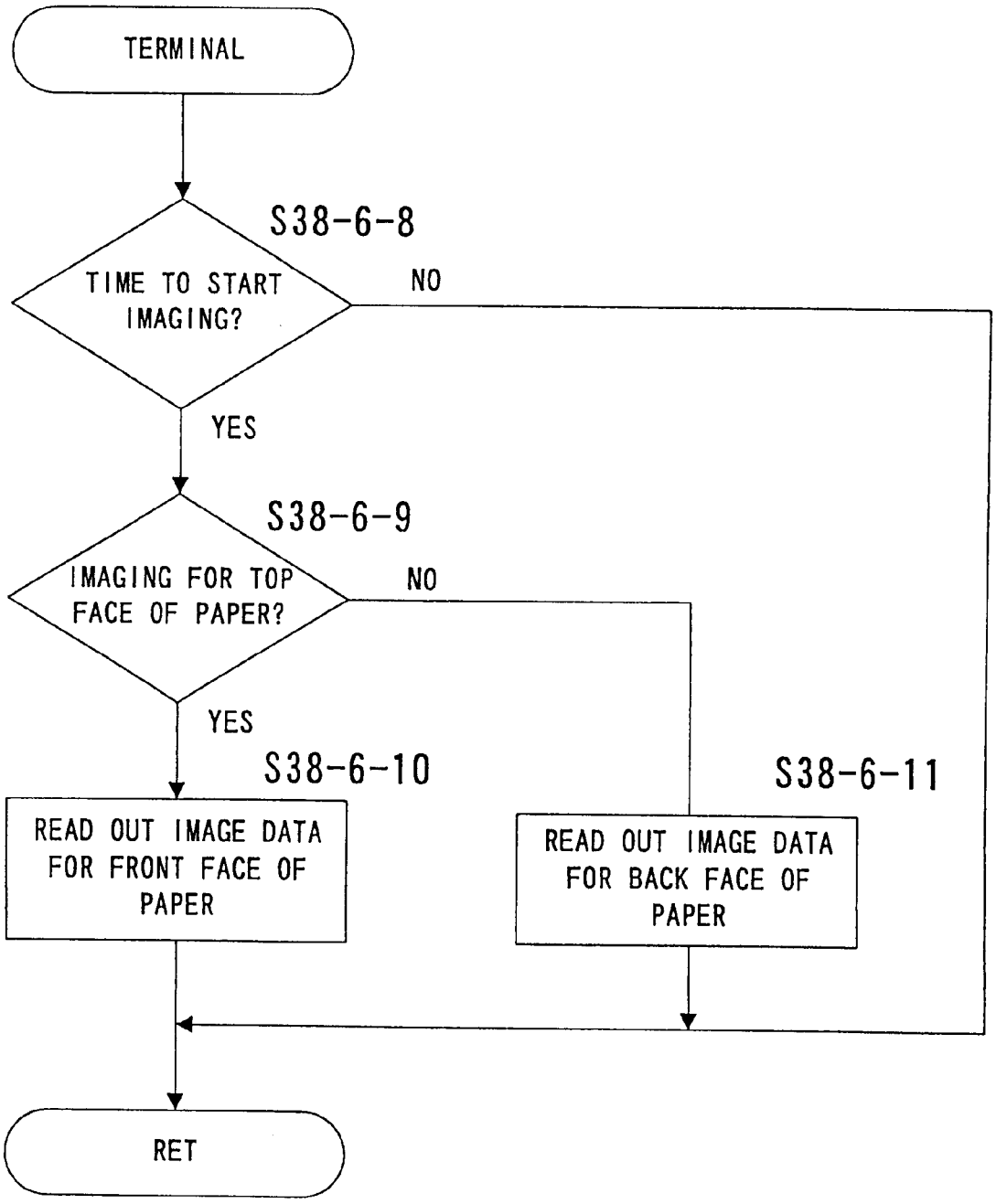
FIG. 44 is a flowchart showing a document page specifying process according to an embodiment of the present invention.

FIG. 44 is a flowchart showing the imaging-side control operation. In S38-6-8, it is determined if it is time to start imaging. If YES in S38-6-8, the process proceeds to S6-8-9, in which it is determined if imaging on the front face of a copy paper is required. If YES in S38-6-9, the image data for the front face is read out in S38-6-10. If NO in S38-6-9, the image data for the back face of that copy paper is read out in S38-6-11.

In the embodiment of the invention, the carrier means for the recording medium, into which an image is transferred, is a looped belt, and papers are transported so as not to overlap the seams of the belt. However, the invention can be equally applied to an imaging apparatus in which photoreceptors (photosensitive drums) are looped belts.

Although the invention has been described using the seam of the image-transfer belt as a factor adversely affecting the image quality, the invention can also be applied to avoid adverse affect on the image quality due to other obstacles in the image-transfer belt, other than the seam.

This application claims priority to Japanese Patent Applications Nos. H9(1997)-321788 filed on Nov. 21, 1997, H9(1997)-321789 filed on Nov. 21, 1997 and H10(1998)-224610 filed on Aug. 7, 1998, each disclosure of which is incorporated by reference in its entirety.

The terms and expressions which have been employed herein are used as terms of description and not of limitation, and there is no intent, in the use of such terms and expressions, of excluding any of the equivalents of the features shown and described or portions thereof, but it is recognized that various modifications are possible within the scope of the invention claimed.

What is claimed is:

1. An image forming apparatus, comprising:

a recording sheet supplying member which supplies a recording sheet placed on a recording sheet supply tray to a transporting path;

a recording sheet transporting member which has an inappropriate portion not suitable for forming an image and transports the recording sheet while holding the recording sheet thereon, said recording sheet transporting member being endless;

a recording sheet feeding member which feeds the recording sheet transferred from said recording sheet supplying member to said recording sheet transporting member;

an inappropriate portion detector which detects said inappropriate portion; and a controller which drives said recording sheet supplying member by sending a request for supplying the recording sheets and controls said recording sheet feeding member so that the recording sheet is not located on said inappropriate portion based on a detected result of said inappropriate portion detector wherein a time period for supplying the recording sheets by said recording sheet supplying member is set to be shorter than that for feeding the recording sheets to said recording sheet transporting member by said recording sheet feeding member.

2. The image forming apparatus as recited in claim 1, wherein said inappropriate portion is a seam.

3. An image forming apparatus, comprising:

a recording sheet supplying member which supplies a recording sheet placed on a recording sheet supply tray to a transporting path;

a recording sheet transporting belt which has a seam and transports the recording sheet while holding the recording sheet thereon, said recording sheet transporting belt being endless;

an image forming member which forms an image on the recording sheet disposed on said recording sheet transporting belt;

a recording sheet feeding member which feeds the recording sheet transferred from said recording sheet supplying member to said recording sheet transporting belt;

an inappropriate portion detector which detects an inappropriate portion of said recording sheet transporting belt which is not suitable for forming an image; and a recording sheet supply requesting means which requests that said recording sheet supplying member supplies the recording sheet;

a first driving member which drives said recording sheet supplying member in response to a request of said recording sheet supply requesting means; and a second driving member which drives said recording sheet feeding member based on a detected result of said inappropriate portion detector wherein a time period for supplying the recording sheets by said recording sheet supplying member is set to be shorter than that for feeding the recording sheets to said recording sheet transporting member by said recording sheet feeding member.

4. An image forming apparatus, comprising:

a recording sheet supplying member which supplies a recording sheet placed on a recording sheet supply tray to a transporting path;

a recording sheet transporting member which has an inappropriate portion not suitable for forming an image and transports a recording sheet while holding the recording sheet thereon, said recording sheet transporting member being endless;

a recording sheet feeding member which feeds the recording sheet transferred from said recording sheet supplying member to said recording sheet transporting member;

an inappropriate portion detector which detects said inappropriate portion;

a circular re-feeding member which re-feeds the recording sheet on said recording sheet transporting member to said recording sheet feeding member;

a recording sheet detector which detects a position of the recording sheet re-fed by said circular re-feeding member; and a controller which controls said recording sheet supplying member so that the recording sheet is supplied to said transporting path so as to avoid said inappropriate portion based on a detected result of said inappropriate portion detector and to avoid a collision with a re-fed recording sheet based on a detected result of said recording sheet detector, and controls said recording sheet feeding member so that the recording sheet is fed to said recording sheet transporting member so as to avoid said inappropriate portion based on a detected result of said inappropriate portion detector.

5. The image forming apparatus as recited in claim 4, wherein a time period for feeding the recording sheets by said recording sheet supplying member is set to be shorter than that for feeding the recording sheets to said recording sheet transporting member by said recording sheet feeding member.

6. The image forming apparatus as recited in claim 4, wherein said inappropriate portion is a seam.

7. An image forming apparatus, comprising:

a recording sheet supplying member which supplies a recording sheet placed on a recording sheet supply tray to a transporting path;

a recording sheet transporting belt which has a seam and transports the recording sheet while holding the recording sheet thereon, said recording sheet transporting belt being endless;

an image forming member which forms an image to the recording sheet disposed on said recording sheet transporting belt;

a recording sheet feeding member which feeds the recording sheet transferred from said recording sheet supplying member to said recording sheet transporting belt;

an inappropriate portion detector which detects an inappropriate portion on said recording sheet transporting belt, said inappropriate portion being not suitable for forming an image;

a circularly re-feeding member which re-feeds the recording sheet on said recording sheet transporting belt to said recording sheet feeding member;

a recording sheet detector which detects a position of the recording sheet re-fed by said circularly re-feeding member;

a recording sheet supply requesting means which requests that said recording sheet supplying member supplies the recording sheet;

a first permission means which allows to drive said recording sheet supplying member based on a detected result of said inappropriate portion detector;

a second permission means which allows to drive said recording sheet supplying member based on a detected result of said recording sheet detector;

a third permission means which allows to drive said recording sheet feeding member based on a detected result of said inappropriate portion detector;

a driving member which drives said recording sheet supplying member when said driving member receives a request from said recording sheet supply requesting means and said first and second permission means allow; and a driving member which drives said recording sheet feeding member when said third permission means allows.

8. An image forming apparatus, comprising:

a recording sheet supplying member which supplies a recording sheet placed on a recording sheet supply tray to a transporting path;

a recording sheet transporting member which has an inappropriate portion not suitable for forming an image and transports a recording sheet while holding the recording sheet thereon, said recording sheet transporting member being endless;

a recording sheet feeding member which feeds the recording sheet transferred from said recording sheet supplying member to said recording sheet transporting member;

a circulation path in which the recording sheet is inverted and circulated in order to form an image on both sides of the recording sheet; and a controller which controls a feeding of the recording sheets so as to avoid said inappropriate portion based on a number of the recording sheets which can be accommodated in a circumference of said recording sheet transporting member.

9. The image forming apparatus as recited in claim 8, wherein said circulation path is designed so as to satisfy the condition:

$$L1+L2=N\times Ls+Li,$$

where

L1+L2 is a length of said circulation path excluding a recording sheet inverting portion;

Ls is a circumference length of said recording sheet transporting member;

Li is an interval of certain recording sheets; and

N is an integer.

10. The image forming apparatus as recited in claim 9, wherein N is an even number.

11. The image forming apparatus as recited in claim 8, wherein a position of the recording sheet is previously determined based on the number of essentially the longest recording sheets which can be fed so as to avoid said inappropriate portion and can be accommodated in a circumference of said recording sheet transporting member.

12. The image forming apparatus as recited in claim 11, wherein the position is determined by calculating an interval between said inappropriate portion and the recording sheet and/or an interval between the recording sheets.

13. An image forming apparatus, comprising:

a recording sheet supplying member which supplies a recording sheet placed on a recording sheet supply tray to a transporting path;

a recording sheet transporting member which has an inappropriate portion not suitable for forming an image and transports a recording sheet while holding the recording sheet thereon, said recording sheet transporting member being endless;

a recording sheet feeding member which feeds the recording sheet transferred from said recording sheet supplying member to said recording sheet transporting member; and a circulation path in which the recording sheet is inverted and circulated in order to form images on both sides of the recording sheet, wherein said circulation path is designed so as to satisfy the condition;

$$L1+L2=N\times Ls+Li;$$

where

L1+L2 is a length of said circulation path excluding a recording sheet inverting portion;

Ls is a circumference length of said recording sheet transporting member;

Li is an interval of recording sheets; and

N is an integer.

14. The image forming apparatus as recited in claim 13, wherein N is an even number.

15. The image forming apparatus as recited in claim 13, wherein Li is an interval of letter-size papers placed in the transverse direction of said recording sheet transporting member.

16. In an image forming apparatus which includes a recording sheet transporting device, said recording sheet transporting device comprising:

a supply unit including a supplying member which supplies a recording sheet placed on a supply tray to a path;

a feeding unit which is located on said path, said feeding unit feeding the recording sheet supplied by said supplying member;

a holding member which transports the recording sheet fed by said feeding unit while holding the recording sheet thereon, said holding member having an inappropriate portion not suitable for forming an image on the recording sheet;

a detector which detects said inappropriate portion; and a controller which drives said supplying member in response to a request for feeding the recording sheet, and controls said feeding unit so that the recording sheet avoids interference with said inappropriate portion based on the detected result of said detector wherein a time period for supplying the recording sheets by said supplying member is set to be shorter than that for feeding the recording sheets to said holding member by said feeding unit.

17. The recording sheet transporting device as recited in claim 16, wherein said inappropriate portion is a seam of said holding member.

18. The recording sheet transporting device as recited in claim 17, wherein said holding member is a belt.

19. An image forming apparatus comprising:

a supplying unit including a supplying member which supplies a recording sheet placed on a supply tray;

a feeding unit which feeds the recording sheet supplied by said supplying member;

a holding member which transports the recording sheet fed by said feeding unit while holding the recording sheet thereon, said holding member having an inappropriate portion:

an image forming unit which forms an image on the recording sheet held on said holding member;

a detector which detects said inappropriate portion;

request means for requesting said supplying unit to supply the recording sheet;

a first driver which drives said supplying member in response to the request from said request means; and a second driver which drives said feeding unit based on the detected result of said detector wherein a time period for supplying the recording sheets by said supplying member is set to be shorter than that for feeding the recording sheets to said holding member by said feeding unit.

20. The image forming apparatus as recited in claim 19, wherein said inappropriate portion is a seam of said holding member.

21. The image forming apparatus as recited in claim 21, wherein said holding member is a belt.

* * * * *

UNITED STATES PATENT AND TRADEMARK OFFICE

CERTIFICATE OF CORRECTION

PATENT NO. : 6,029,041
DATED : February 22, 2000
INVENTOR(S) : Yoshiaki Takano, et al.

It is certified that error appears in the above-identified patent and that said Letters Patent is hereby corrected as shown below:

Column 32, claim 21,
Line 17, change "21" to -- 20 --.

Signed and Sealed this

Fourth Day of September, 2001

*Attest:*

Nicholas P. Godici

NICHOLAS P. GODICI
*Acting Director of the United States Patent and Trademark Office*

*Attesting Officer*